US008002383B2

(12) United States Patent
Kachi et al.

(10) Patent No.: US 8,002,383 B2
(45) Date of Patent: Aug. 23, 2011

(54) LIQUID EJECTION APPARATUS AND IMAGE FORMING APPARATUS

(75) Inventors: Yasuhiko Kachi, Kanagawa (JP); Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 98 days.

(21) Appl. No.: 12/490,134

(22) Filed: Jun. 23, 2009

(65) Prior Publication Data

US 2009/0267987 A1 Oct. 29, 2009

Related U.S. Application Data

(62) Division of application No. 11/236,644, filed on Sep. 28, 2005, now Pat. No. 7,568,782.

(30) Foreign Application Priority Data

Sep. 29, 2004 (JP) ..... 2004-285105

(51) Int. Cl.
*B41J 2/165* (2006.01)

(52) U.S. Cl. ..... 347/33; 347/22

(58) Field of Classification Search ..... 347/33, 347/22

See application file for complete search history.

(56) References Cited

U.S. PATENT DOCUMENTS

| | | | |
|---|---|---|---|
| 5,126,765 | A | 6/1992 | Nakamura et al. |
| 5,486,850 | A | 1/1996 | Nakamura et al. |
| 5,627,571 | A | 5/1997 | Anderson et al. |
| 6,056,387 | A | 5/2000 | Kaneko et al. |
| 6,128,461 | A | 10/2000 | Yoshikawa et al. |
| 6,241,337 | B1 | 6/2001 | Sharma et al. |
| 7,008,039 | B2 | 3/2006 | Yamazaki et al. |
| 7,159,962 | B2 | 1/2007 | Wouters et al. |
| 2001/0007459 | A1 | 7/2001 | Midorikawa |
| 2002/0085058 | A1 | 7/2002 | Griffin et al. |
| 2004/0233247 | A1 | 11/2004 | Yamada et al. |
| 2006/0066664 | A1 | 3/2006 | Kachi et al. |

FOREIGN PATENT DOCUMENTS

| | | | |
|---|---|---|---|
| JP | 2-202452 | A | 8/1990 |
| JP | 03047754 | | 2/1991 |
| JP | 3-222754 | A | 10/1991 |
| JP | 05338189 | | 12/1993 |
| JP | 06-206320 | A | 7/1994 |
| JP | 07-152297 | A | 6/1995 |
| JP | 7-246708 | A | 9/1995 |
| JP | 07304183 | | 11/1995 |
| JP | 10044446 | | 2/1998 |
| JP | 10-143037 | A | 5/1998 |
| JP | 11174922 | A | 7/1999 |
| JP | 2001-054949 | | 2/2001 |
| JP | 2001-054949 | A | 2/2001 |
| JP | 2003-145781 | | 5/2003 |
| JP | 2004-130595 | A | 4/2004 |
| JP | 2004-167913 | A | 6/2004 |
| JP | 2006-095880 | A | 4/2006 |

*Primary Examiner* — Julian D Huffman
*Assistant Examiner* — Jason S Uhlenhake
(74) *Attorney, Agent, or Firm* — Birch, Stewart, Kolasch & Birch, LLP

(57) ABSTRACT

The liquid ejection apparatus comprises: a liquid ejection head having an ejection port surface on which ejection ports for ejecting liquid are formed; a wiping device having a blade member which wipes and cleans the ejection port surface; a sliding device which causes the blade member to slide relatively with respect to the ejection port surface; a state identification device which identifies at least one state, of a state of the ejection ports, a state of the ejection port surface, and an operational state of the blade member when sliding over the ejection port surface; and a cleaning capability modification device which modifies a cleaning capability of the wiping device in accordance with a determination result of the state identification device.

7 Claims, 30 Drawing Sheets

LIQUID EJECTION APPARATUS AND IMAGE FORMING APPARATUS

This application is a Divisional of application Ser. No. 11/236,644 filed on Sep. 28, 2005 now U.S. Pat. No. 7,568,782, and for which priority is claimed under 35 U.S.C. §120. Application Ser. No. 11/236,644 claims priority of Application No. 2004-285105 filed in Japan on Sep. 29, 2004 under 35 U.S.C. §119, the entire contents of all are hereby incorporated by reference into the present application.

BACKGROUND OF THE INVENTION

1. Field of the Invention

The present invention relates to a liquid ejection head and an image forming apparatus, and more particularly, to a structure of a cleaning device which wipes and cleans the ejection port surface (nozzle surface) of a liquid ejection head, and an image forming apparatus, such an inkjet recording apparatus, which adopts this structure.

2. Description of the Related Art

An inkjet recording apparatus applies ink to a recording medium, such as recording paper, by ejecting ink droplets from the nozzles of a recording head (also called a print head), and records text or images (hereinafter, referred to generally as "images") by means of the dots of applied ink, and therefore, a portion of the ink ejected from the nozzles is dispersed in the form of a fine mist which becomes attached to the nozzle surface.

When ink mist, recording paper dust (small pieces of paper), or other types of foreign matter become attached to the vicinity of the nozzles, then it may cause the ink ejection ports (nozzle holes) to become blocked, or cause the ink ejection direction (direction of flight) to change, and hence high-quality printing cannot be achieved.

In order to prevent this, a head cleaning method is widely used, in which the nozzle surface is wiped with a wiper blade (also called simply a "wiper" or "blade") made of a soft material, such as rubber, thereby eliminating material adhering to the vicinity of the nozzles (see Japanese Patent Application Publication Nos. 7-246708, 2-202452, 3-222754 and 2004-130595).

In respect of head cleaning technology of this kind, Japanese Patent Application Publication No. 7-246708 discloses a method for determining the state of wetting of the nozzle surface by means of optical determination, and reducing the number of cleaning operations performed, and the amount of ink consumed, by using suctioning and wiping in a selective fashion. Japanese Patent Application Publication No. 7-246708 discloses that a selection is made whether to perform suctioning or wiping, in accordance with the determination results of the state of wetting of the nozzle surface; however, there is no disclosure regarding technology for improving the cleaning performance achieved by wiping.

Japanese Patent Application Publication No. 2-202452 discloses technology which seeks to reduce wear of the liquid repelling film on a nozzle surface, as well as reducing color mixing, by disposing a cleaning device which is used conjointly with a capping device, and cleaning the nozzle groups selectively only in those heads which require cleaning. However, there is no mention of a method for increasing the cleaning efficiency of wiping.

Japanese Patent Application Publication No. 3-222754 discloses technology for detecting cases where restoration operations have been performed consecutively for a prescribed time period, and changing the free length (amount of projection) of a wiping member, thereby successively increasing the bending rigidity of the member, in such a manner that wiping efficiency is improved and the durability of the nozzle surface and the wiping member is improved. Japanese Patent Application Publication No. 3-222754 discloses technology for altering the rigidity of a wiping member by comparison with set restoration operation intervals; however, this simply changes the rigidity of the blade by inferring the state of the nozzles from the timing of the previous cleaning operation, and although it aims to increase the cleaning effect, it takes time until suitable cleaning becomes possible.

Japanese Patent Application Publication No. 2004-130595 discloses technology for an inkjet recording apparatus, provided with a counter which measures the number of wiping actions (number of wipes) and a device for previously storing a reference value for the performable number of wipes, in which the number of the counter is compared with the reference value and a report regarding replacement of the wiping member is provided to the user. Therefore, replacement of the wiping member can be prompted at a suitable time, and decline in print quality due to degraded wiping functions can be prevented in advance. However, Japanese Patent Application Publication No. 2004-130595 simply prompts replacement of the blade to the user, and does not disclose means for improving the cleaning capability.

SUMMARY OF THE INVENTION

The present invention has been contrived in view of the foregoing, an object thereof being to provide a liquid ejection apparatus having a cleaning apparatus, and an image forming apparatus using same, which is able to improve cleaning functions by achieving an effective wiping operation in accordance with the circumstances.

In order to attain the aforementioned object, the present invention is directed to a liquid ejection apparatus, comprising: a liquid ejection head having an ejection port surface on which ejection ports for ejecting liquid are formed; a wiping device having a blade member which wipes and cleans the ejection port surface; a sliding device which causes the blade member to slide relatively with respect to the ejection port surface; a state identification device which identifies at least one state, of a state of the ejection ports, a state of the ejection port surface, and an operational state of the blade member when sliding over the ejection port surface; and a cleaning capability modification device which modifies a cleaning capability of the wiping device in accordance with a determination result of the state identification device.

According to the present invention, the state of the ejection ports of the liquid ejection head which is to be cleaned, the state of the ejection surface, or the operational state of the blade member, namely the relative positions of the ejection surface and the blade member, when the blade member is slid over the ejection port surface, and the like, is identified by the state identification device, and the cleaning capability can be changed and controlled suitably in such a manner that a suitable cleaning effect is obtained, on the basis of the identification results. Thereby, it is possible to implement an effective wiping operation in accordance with the circumstances, and therefore, the cleaning function can be improved.

The sliding device causes the liquid ejection head and the blade member to slide relatively with respect to each other, by moving at least one of the liquid ejection head and the blade member. In other words, the sliding device may move the blade member with respect to the nozzle surface (liquid ejection head), or it may move the liquid ejection head with respect to the blade member, or it may combine these actions.

Preferably, the state identification device comprises at least one of: an ejection abnormality determination device which determines an ejection abnormality in the ejection port; a contact pressure determination device which determines a contact pressure of the blade member with respect to the ejection port surface; a frictional force identification device which identifies a frictional force between the blade member and the ejection surface; a vibration determination device which determines a vibration of the blade member during sliding over the ejection ports; and an amount of distortion determination device which determines an amount of distortion caused by bending deformation of the blade member during sliding over the ejection ports.

By using one device, or a suitable combination of devices, from the aforementioned ejection abnormality determination device, contact pressure determination device, frictional force identification device, vibration determination device, amount of distortion determination device, or the like, it is possible to ascertain the state of the ejection ports and the ejection surface, or the operation state of the blade member.

Preferably, the cleaning capability modification device comprises at least one of: a relative position control device which controls relative positions of the ejection port surface and the blade member in a direction substantially perpendicular to the ejection port surface; a relative speed control device which controls a speed of relative movement between the ejection port surface and the blade member due to the sliding device; and a wet state control device which controls a state of wetting between the blade member and the ejection port surface.

By changing the relative position between the blade member and the ejection port surface by means of the relative position control device, it is possible to control the contact pressure of the blade member against the ejection port surface, and it is also possible to vary the contact characteristics between same, and the force applied for eliminating solid adhering matter, and the like. Furthermore, by adjusting the speed of relative movement between the ejection port surface and the blade member (the sliding speed) by means of the relative speed control device, and by creating a wet state by means of the wet state control device, it is possible to prevent the occurrence of a stick and slip phenomenon. Furthermore, the effect of eliminating solid adhering matter is raised by performing wiping in a wet state. As a device for changing the wet state, it is possible to use ejection control in the liquid ejection head, in such a manner that wiping in a wet state is performed by ejecting liquid from the ejection ports of the liquid ejection head onto the tip of the blade member.

Preferably, the liquid ejection apparatus further comprises: a cleaning capability identification device which identifies a cleaning capability of the wiping device; and a cleaning capability restoration device which restores the cleaning capability of the wiping device in accordance with the cleaning capability identified by the cleaning capability identification device.

According to the present invention, since the cleaning capability of the wiping device including the blade member is identified by the cleaning capability identification device, and the cleaning capability restoration device is operated on the basis of the identification results, then it is possible to restore the cleaning capability of the wiping device, automatically. Thereby, desired cleaning characteristics (for example, the initial cleaning characteristics) can be maintained for a long period of time.

Here, "restoration" is not limited to a mode for restoring the cleaning capability of the actual blade (the same blade) of which cleaning capability has been identified, but rather, it may also include modes in which the cleaning capability of the wiping device is restored by switching the blade to be used, or the like.

Preferably, the state identification device also serves as the cleaning capability identification device; and the cleaning capability modification device also serves as the cleaning capability restoration device.

In order to be able to identify the cleaning capability of the wiping device by using the state identification device, and to restore the cleaning capability by means of the cleaning capability modification device, desirably, the state identification device is combined with the cleaning capability identification device, and the cleaning capability modification device is combined with the cleaning capability restoration device.

For example, it is possible to identify the amount of wear of the blade member by measuring the contact pressure using the contact pressure determination device which determines the contact pressure of the blade member against the ejection port surface. The contact conditions of the blade member are controlled accordingly. By adjusting the contact pressure during cleaning within a suitable range of contact pressure, it is possible to maintain a desired cleaning capability.

Moreover, in a further mode, it is preferable that the cleaning capability identification device comprises a counting device which counts the number of contact and slide actions of the blade member with respect to the ejection port surface, and an amount of wear identification device which identifies the amount of wear of the blade member on the basis of the count value of the counting device, from the correlation between the number of contact and slide actions of the blade member and the amount of wear.

Since there is a correlation between the amount of contact and slide actions (number of wipes) and the amount of wear of the blade member, it is possible to infer (identify) the amount of wear from the count value for the number of contact and slide actions. For example, by adopting a composition in which a correlation information storing device is provided for storing information indicating a correlation between the number of contact and slide actions of the blade member and the amount of wear, it is possible to determine the amount of wear from this correlation information. Furthermore, since the number of contact and slide actions reflects the amount of wear of the blade member, due to the aforementioned correlation, it is also possible to handle the count value for the number of contact and slide actions as a value corresponding to the amount of wear, without deducing a value for the amount of wear directly.

In yet a further mode, it is preferable that the cleaning capability identification device comprises a drive load determination device which determines the drive load of the sliding device, and a frictional force identification device which identifies the frictional force between the blade member and the ejection port surface from the correlation between the drive load and the frictional force between the blade member and the ejection port surface, on the basis of the drive load determined by the drive load determination device.

For example, there is a mode in which the cleaning capability identification device comprises a current value determination device which determines the current value of the slider motor of the sliding device, and a frictional force identification device which identifies the frictional force between the blade member and the ejection port surface on the basis of the current value determined by the current value determination device, from a correlation between the motor current value and the frictional force between the blade member and the ejection port surface.

Since the load of the slider motor changes in accordance with the magnitude of the frictional force between the blade member and the ejection port surface, it is possible to identify the frictional force from the current value of the slider motor by using the correlation between these two factors.

Alternatively, in a further mode, it is preferable that the cleaning capability identification device comprises a distortion determination device which determines the amount of distortion caused by bending deformation of the blade member as it slides over the ejection port surface, and a frictional force identification device which identifies the frictional force between the blade member and the ejection port surface on the basis of the amount of distortion determined by the distortion determination device, from the correlation between the amount of distortion and the frictional force between the blade member and the ejection port surface.

Since the amount of bending deformation (amount of distortion) of the blade member during sliding changes in accordance with the magnitude of the frictional force between the blade member and the ejection port surface, it is possible to identify the frictional force from the amount of distortion of the blade member, by using the correlation between these two factors.

Similarly to the case of the amount of wear identification device, a correlation information storage device which stores information indicating a correlation is provided for the aforementioned frictional force identification device, and the frictional force can be determined from this stored correlation information. Furthermore, since the drive load (motor current value) and the amount of distortion of the blade member are values which reflect the frictional force, then rather than deriving the value of the frictional force directly, it is also possible to handle the drive load determined by the drive load determination device, or the current value determined by the current value determination device, or the amount of distortion determined by the distortion determination device, or the like, as a value corresponding to the value of the frictional force.

Preferably, the state identification device comprises a vibration determination device which determines a vibration of the blade member during sliding over the ejection port surface; and the cleaning capability modification device comprises at least one of: a relative speed control device which controls a speed of relative movement between the ejection port surface and the blade member due to the sliding device in such a manner that an amplitude of the vibration determined by the vibration determination device comes within a prescribed range; and a wet state control device which controls a state of wetting between the blade member and the ejection port surface in such a manner that the amplitude of the vibration determined by the vibration determination device comes within the prescribed range.

By controlling at least one of the relative movement speed (sliding speed) and the wet state in such a manner that the vibration of the blade member during a cleaning slide comes within a prescribed (desirable) range of vibration, then it is possible to prevent the occurrence of a stick and slip phenomenon and satisfactory cleaning can be achieved.

Preferably, the wiping device supports a plurality of blade members having different cleaning characteristics; and the cleaning capability modification device comprises a blade switching device which selectively switches the blade member to be used, from the plurality of blade members.

By holding a combination of a plurality of blade members of different types having different blade free lengths, elastic properties, liquid absorption properties, and the like, and by selecting a suitable blade member in accordance with the circumstances, it is possible to achieve a cleaning operation which has a high cleaning effect.

By adapting this mode of the present invention and holding a plurality of wiping members of the same type, and then switching successively to a new wiping member in accordance with determination of expiry of the lifespan of the blade member, then it is possible to maintain the prescribed cleaning capability for a long period of time.

Preferably, the state identification device comprises an ejection abnormality determination device which determines an ejection abnormality in the ejection port; and the cleaning capability modification device comprises: a contact pressure control device which changes a contact pressure of the blade member against the ejection port surface; and a cleaning control device which implements control in such a manner that a cleaning slide is performed by setting the contact pressure of the blade member against the ejection port surface to a prescribed pressure by means of the contact pressure control device, presence or absence of ejection abnormality is confirmed by the ejection abnormality determination device after the cleaning slide, and if an ejection abnormality is determined, a further cleaning slide of the ejection port surface is performed by the blade member, by resetting the contact pressure to a higher contact pressure than a prescribed pressure by means of the contact pressure control device.

By means of this mode, it is possible to perform cleaning at as low as possible a contact pressure, and therefore, the lifespan of the liquid repelling layer of the ejection port surface and the blade member can be improved. Furthermore, it is also possible to eliminate solid adhering matter, and the like, by increasing the contact pressure gradually, while confirming the state of restoration of ejection abnormalities.

Preferably, the contact pressure control device comprises a relative position control device which changes a relative position of the blade member in a direction substantially perpendicular to the ejection port surface.

By controlling the relative positions of the ejection port surface and the blade member (the relative position with respect to a direction substantially perpendicular to the ejection port surface), it is possible to control the contact pressure, and it is also possible to vary the wiping force of the blade member (the force for eliminating solid adhering matter, or the like).

Preferably, the state identification device comprises a soiling state identification device which identifies the state of soiling of the ejection port surface; and the cleaning capability modification device comprises at least one of: a contact pressure control device which changes the contact pressure of the blade member against the ejection port surface, on the basis of the identification results for the state of soiling obtained by the soiling state identification device; and a wet state control device which controls the state of wetting between the blade member and the ejection port surface, on the basis of the identification results for the state of soiling obtained by the soiling state identification device.

For example, if it is judged that foreign matter (solid adhering matter) is attached, from the identification results of the soiling state identification device, then cleaning is performed either by increasing the contact pressure, creating a wet state, or the like, and thus raising the force for eliminating the solid adhering matter.

Preferably, the state identification device comprises: an ejection abnormality determination device which determines an ejection abnormality in the ejection port; and a soiling state identification device which identifies a state of soiling of the ejection port surface; and the cleaning capability modification device comprises a contact pressure control device which implements control in such a manner that a contact pressure of the blade member against the ejection port surface is increased in cases where an ejection abnormality is determined by the ejection abnormality determination device, and a soiling locality is determined by the soiling state identification device.

From the combination of the determination result of the ejection abnormality determination device and the identification result of the soiling state identification device, it is possible to infer (judge) the causes of an ejection abnormality. For example, if there an ejection failure and there is locality in the soiling, then it is possible to determine that the ejection failure is due to the attachment of foreign matter to the ejection port surface, and in this case, cleaning is performed by increasing the contact pressure in order to raise the force for eliminating foreign matter.

Preferably, the state identification device comprises: an ejection abnormality determination device which determines an ejection abnormality in the ejection port; and a soiling state identification device which identifies a state of soiling of the ejection port surface; and the cleaning capability modification device comprises a wet state control device which implements control in such a manner that a wet state is created between the blade member and the ejection port surface in cases where an ejection abnormality is determined by the ejection abnormality determination device, and a soiling locality is determined by the soiling state identification device.

For example, if there an ejection failure and if there is locality in the soiling, then it is possible to determine that the ejection failure is due to the attachment of foreign matter to the ejection port surface, and in this case, cleaning is performed by increasing the contact pressure in order to raise the force for eliminating foreign matter.

More desirably, a composition which combines the wet state control device and the contact pressure control device is adopted, in such a manner that foreign matter can be eliminated effectively by increasing the contact pressure as well as performing wiping in a wet state.

Preferably, the liquid ejection apparatus further comprises a cleaning control device which implements at least one operation of a preliminary ejection operation and a suction operation of the liquid inside the liquid ejection head, in a case where an ejection abnormality is determined by the ejection abnormality determination device and a soiling locality is not determined by the soiling state identification device.

For example, if an ejection failure has been determined but locality of the soiling on the ejection surface is not determined, then it is possible to judge that the ejection failure has occurred due to a cause that is located inside the liquid ejection head (for example, increased viscosity of the liquid in the vicinity of the meniscus of the ejection ports). In this case, a preliminary ejection operation or suctioning operation, which is expected to have a greater restoration effect than cleaning by wiping, is carried out.

By selecting a suitable cleaning method by means of control of this kind, effective cleaning can be achieved, and it is possible to restore the ejection characteristics of a liquid ejection head in a short period of time.

Preferably, the state identification device comprises a frictional force identification device which identifies a frictional force between the blade member and the ejection surface; and the cleaning capability modification device comprises a cleaning control device which selects a cleaning method in accordance with a magnitude of the frictional force, if a frictional force locality is determined on the ejection surface, according to information obtained by the frictional force identification device.

For example, if the magnitude of the frictional force varies depending on the location on the ejection surface, then cleaning is performed in a wet state in areas where the frictional force is greater than a prescribed value, and cleaning is performed in the current state in areas where the frictional force is smaller than the prescribed value. By selecting a suitable cleaning method in accordance with the magnitude of the frictional force in this way, it is possible to achieve effective cleaning.

Preferably, the liquid ejection apparatus further comprises: a vibrating device which causes relative vibration of the blade member with respect to the ejection port surface, wherein wiping and cleaning of the ejection port surface by the blade member is carried out while applying vibration by means of the vibrating device.

The cleaning effect (and in particular, the capability for eliminating solid adhering matter) is improved by imparting a relative vibration between the blade member and the ejection port surface. Even more desirable is a composition in which the vibrating device described above is combined with the contact pressure determination device or the vibration determination device.

In order to attain the aforementioned object, the present invention is also directed to an image forming apparatus, comprising the above-described liquid ejection apparatus, the image forming apparatus forming an image on a recording medium by means of droplets of the liquid ejected from the ejection ports.

A compositional example of a liquid ejection head in the image forming apparatus according to the present invention is a full line type inkjet head having a nozzle row in which a plurality of nozzles (ejection ports) are arranged through a length corresponding to the full width of the recording medium.

In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type inkjet head is usually disposed in a direction perpendicular to the relative feed direction (relative conveyance direction) of the recording medium, but modes may also be adopted in which the inkjet head is disposed following an oblique direction that forms a prescribed angle with respect to the direction perpendicular to the relative conveyance direction.

The "recording medium" in the image forming apparatus indicates a medium on which an image is recorded by means of liquid ejected from the liquid ejection head (this medium may also be called an ejection receiving medium, print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of a liquid droplet ejection head, and an intermediate transfer medium, and the like.

The conveyance device for causing the recording medium and the liquid ejection head to move relative to each other may include a mode where the recording medium is conveyed with respect to a stationary (fixed) head, or a mode where a head is moved with respect to a stationary recording medium, or a mode where both the head and the recording medium are moved.

According to the present invention, the state of the ejection ports of a liquid ejection head, the state of the ejection surface, or the operational state of a blade member during sliding over the ejection port surface, or the like, is identified by a state identification device, and the cleaning capability is controlled suitably on the basis of the identification results. Therefore, it is possible to implement an effective cleaning operation in accordance with the circumstances, and hence cleaning functions can be improved. Furthermore, by using the state identification device or the cleaning capability modification device, it is also possible to restore cleaning performance which has declined to deterioration of the blade, or the like, and therefore, the prescribed cleaning performance can be maintained for a long period of time.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
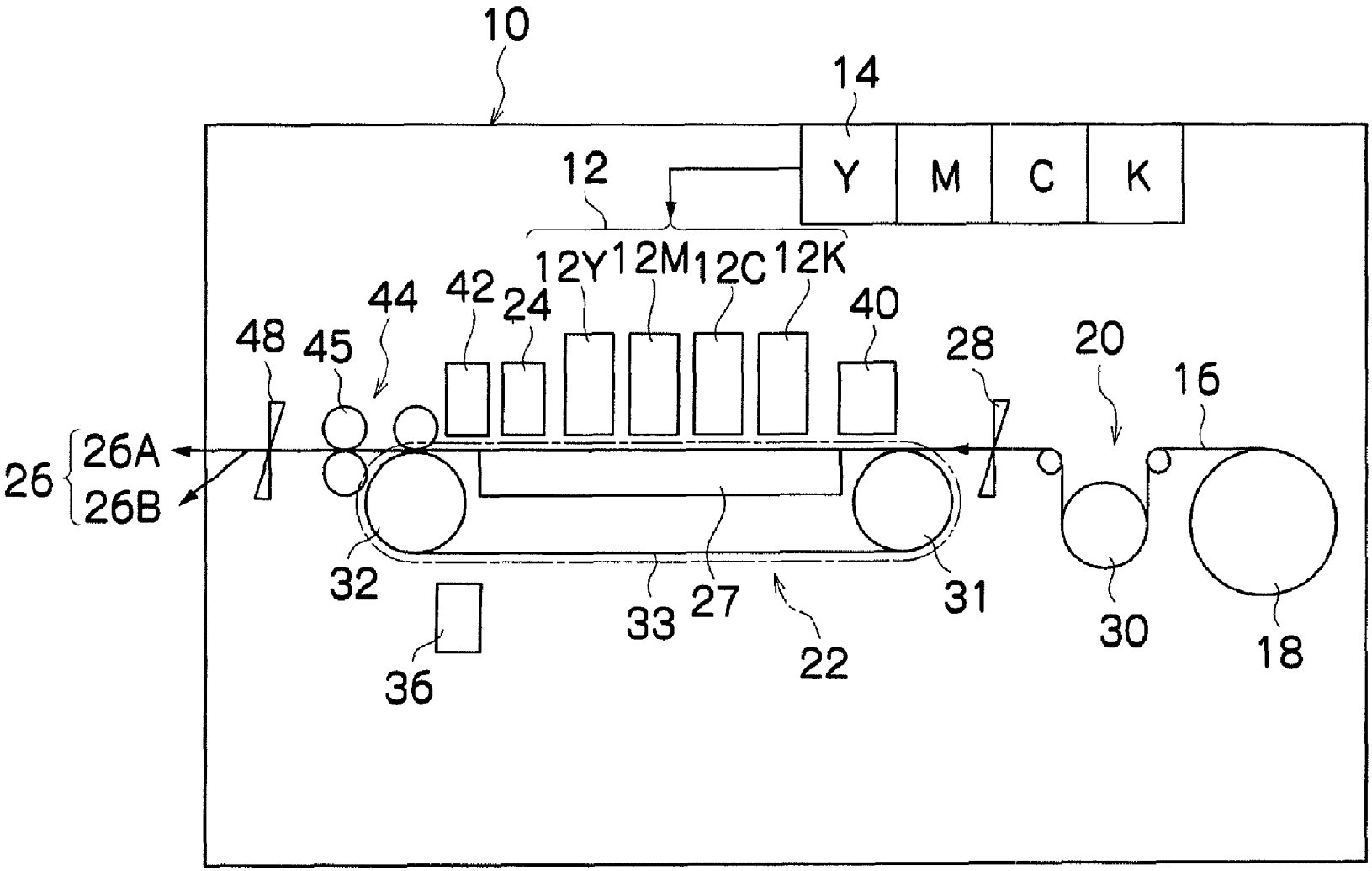
FIG. 1 is a general schematic drawing of an inkjet recording apparatus which forms one embodiment of an image forming apparatus according to the present invention.

FIG. 1 is a general schematic drawing of an inkjet recording apparatus which forms one embodiment of an image forming apparatus according to the present invention. As shown in FIG. 1, the inkjet recording apparatus 10 comprises: a print unit 12 having a plurality of inkjet recording heads (hereafter, called "print heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; a paper output unit 26 for outputting recorded recording paper (printed matter) to the exterior; and a cleaning unit (cleaning apparatus) 27 for cleaning the print heads 12K, 12C, 12M, 12Y of the print unit 12.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (medium) can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (a first cutter) 28 is provided as shown in FIG. 1, and the continuous paper is cut into a desired size by the cutter 28. When cut paper is used, the cutter 28 is not required.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

There are no particular limitations on the structure of the belt conveyance unit 22, and it may use vacuum suction conveyance in which the recording paper 16 is conveyed by being suctioned onto the belt 33 by negative pressure created by suctioning air through suction holes provided on the belt surface, or it may be based on electrostatic attraction.

The belt 33 has a width dimension that is broader than the width of the recording paper 16, and in the case of the vacuum suction conveyance method described above, a plurality of suction holes (not shown) are formed in the surface of the belt. Furthermore, a suction chamber (not shown) is disposed in a position facing the nozzle surface of the print unit 12 and the sensor surface of the print determination unit 24 on the inner side of the belt 33 between the rollers 31 and 32. The suction chamber provides suction with a fan (not shown) to generate a negative pressure, and the recording paper 16 is held on the belt 33 by suction.

The belt 33 is driven in the counterclockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from right to left in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2:
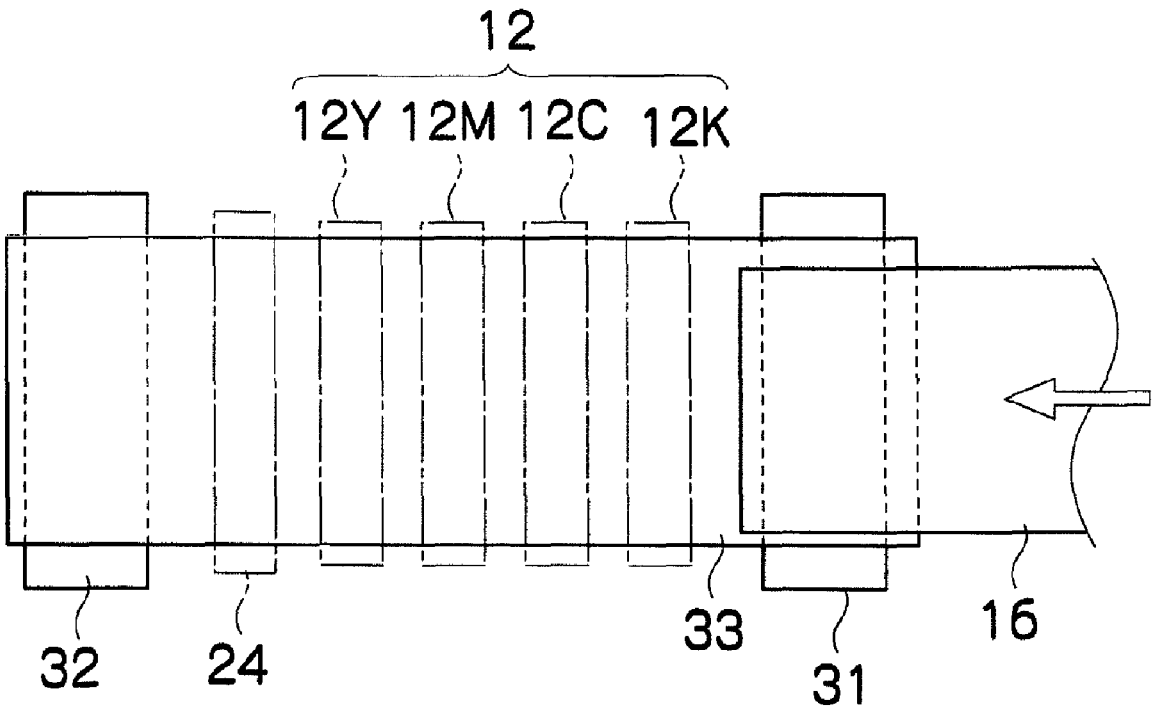
FIG. 2 is a plan view of the principal part of the peripheral area of a print unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 shown in FIG. 1 has an image sensor for capturing an image of the ink droplet deposition result of the print unit 12, and functions as a device to check for ejection defects such as blockages, landing position displacement, and the like, of the nozzles from the image of ejected droplets read in by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively.

If the main image and the test print are formed simultaneously in a parallel fashion, on a large piece of printing paper, then the portion corresponding to the test print is cut off by means of the cutter (second cutter) 48. The cutter 48 is disposed immediately in front of the paper output section 26, and it serves to cut and separate the main image from the test print section, in cases where a test image is printed onto the white margin of the image.

Although not shown in FIG. 1, the paper output unit 26A for the target prints is provided with a sorter for collecting prints according to print orders.

The cleaning unit 27 is disposed below the belt 33 in a position corresponding to that of the print unit 12, and although not shown in FIG. 1, it has wipers (blade members) for wiping and cleaning the nozzle surfaces of the print heads 12K, 12C, 12M and 12Y.

Structure of the Head

Next, the structure of a head will be described. The heads 12K, 12C, 12M and 12Y of the respective ink colors have the same structure, and a reference numeral 50 is hereinafter designated to any of the heads.

Figure 3A:
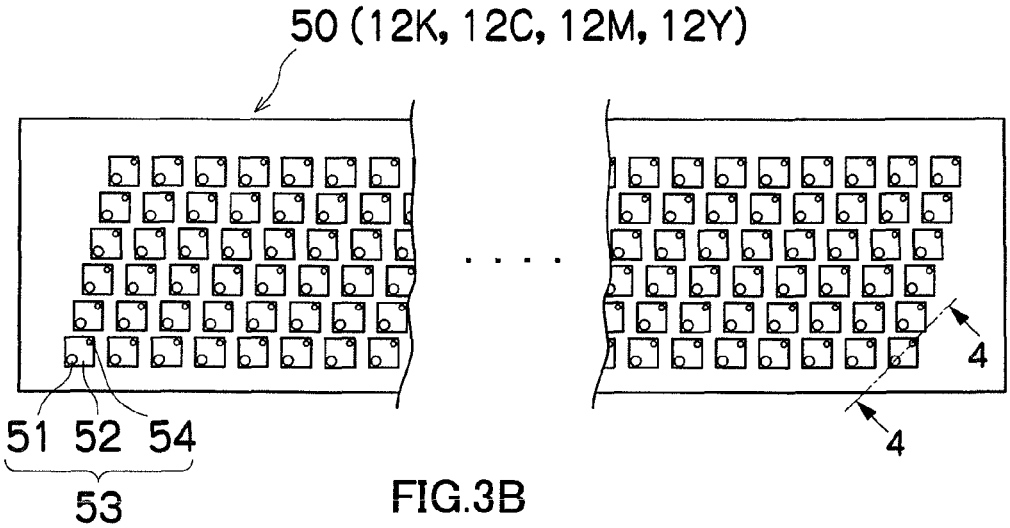
FIG. 3A is a plan view perspective diagram showing an example of the composition of a print head.
Figure 3B:
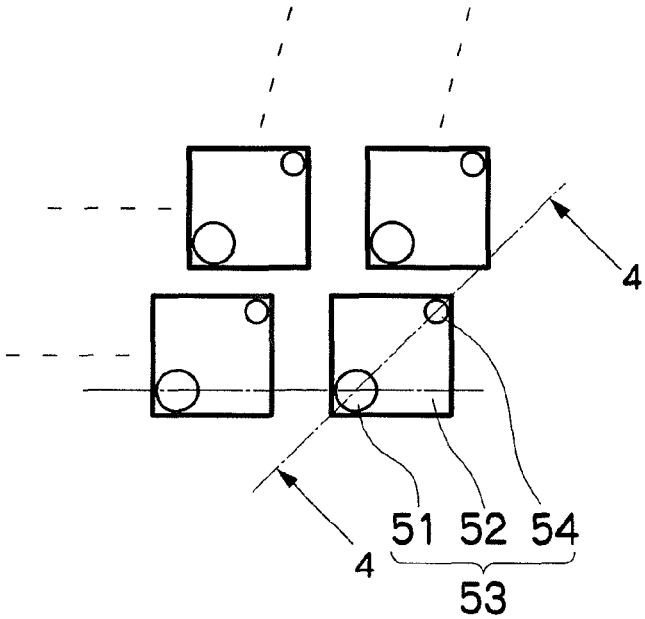
FIG. 3B is a principal enlarged view of FIG. 3A.
Figure 3C:
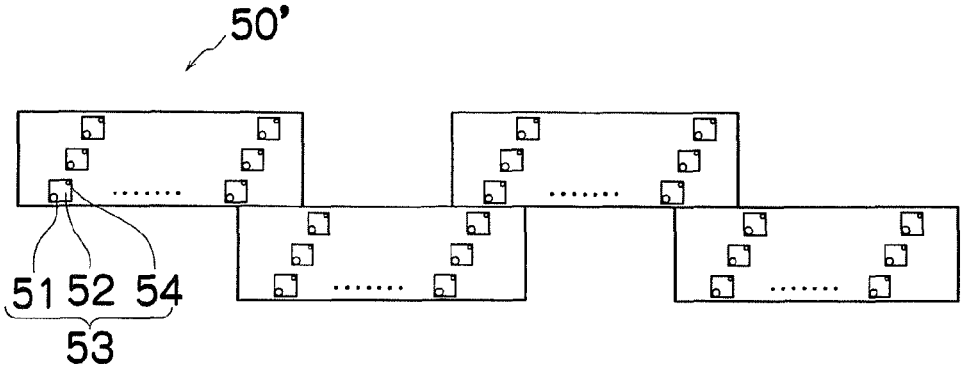
FIG. 3C is a plan view perspective diagram showing a further example of the composition of a full line head.
Figure 4:
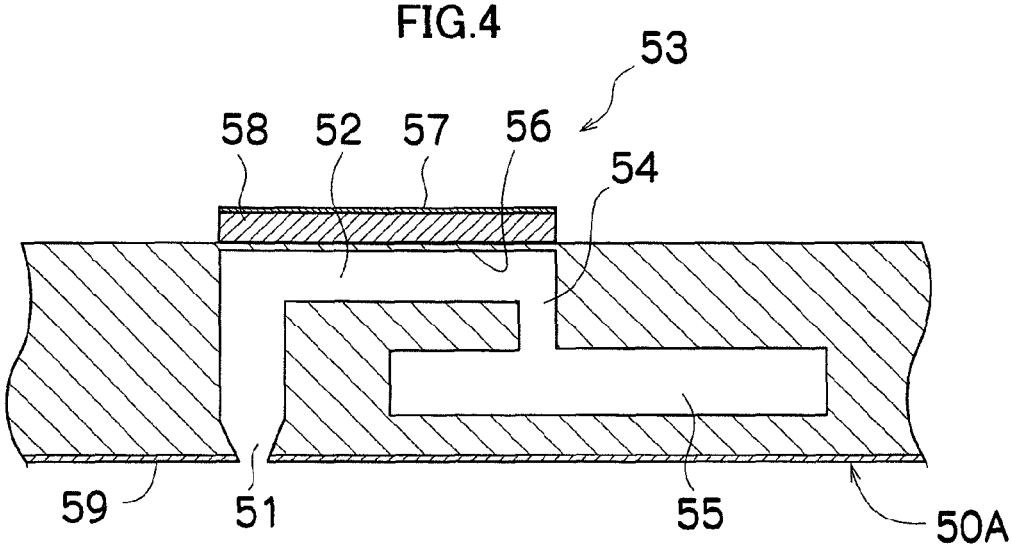
FIG. 4 is a cross-sectional view along line 4-4 in FIG. 3A.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIG. 3A, showing the inner structure of a droplet ejection element (an ink chamber unit for one nozzle 51).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units (droplet ejection elements) 53, each comprising a nozzle 51 forming an ink ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head modules 50' having a plurality of nozzles 51 arrayed in a two-dimensional fashion.

As shown in FIGS. 3A and 3B, the planar shape of the pressure chamber 52 provided corresponding to each nozzle 51 is substantially a square shape, and an outlet port to the nozzle 51 is provided at one of the ends of the diagonal line of the planar shape, while an inlet port (supply port) 54 for supplying ink is provided at the other end thereof. The shape of the pressure chamber 52 is not limited to that of the present embodiment sand various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate (a diaphragm that also serves as a common electrode) 56 which forms one surface (in FIG. 4, the ceiling) of the pressure chamber 52. When a drive voltage is applied to the individual electrode 57 and the common electrode, the actuator 58 deforms, thereby changing the volume of the pressure chamber 52. This causes a pressure change which results in ink being ejected from the nozzle 51. For the actuator 58, it is possible to use a piezoelectric element using a piezoelectric body, such as lead zirconate titanate, barium titanate, or the like. When the displacement of the actuator 58 returns to its original position after ejecting ink, new ink is supplied to the pressure chamber 52 via the supply port 53 from the common channel 55.

Furthermore, as shown in the drawings, a liquid repelling layer 59 is provided on a nozzle surface 50A. There are no particular restrictions on the method for imparting liquid repelling properties to the nozzle surface 50A (the liquid repelling process method), and possible methods include, for example, a method involving coating of a fluorine-based liquid repelling material, or a method involving the formation of a thin layer on the nozzle surface by vapor deposition of a liquid repelling material, such as particles of a fluorine-based high polymer (e.g., polytetrafluoroethylene (PTFE)), in a vacuum.

Figure 5:
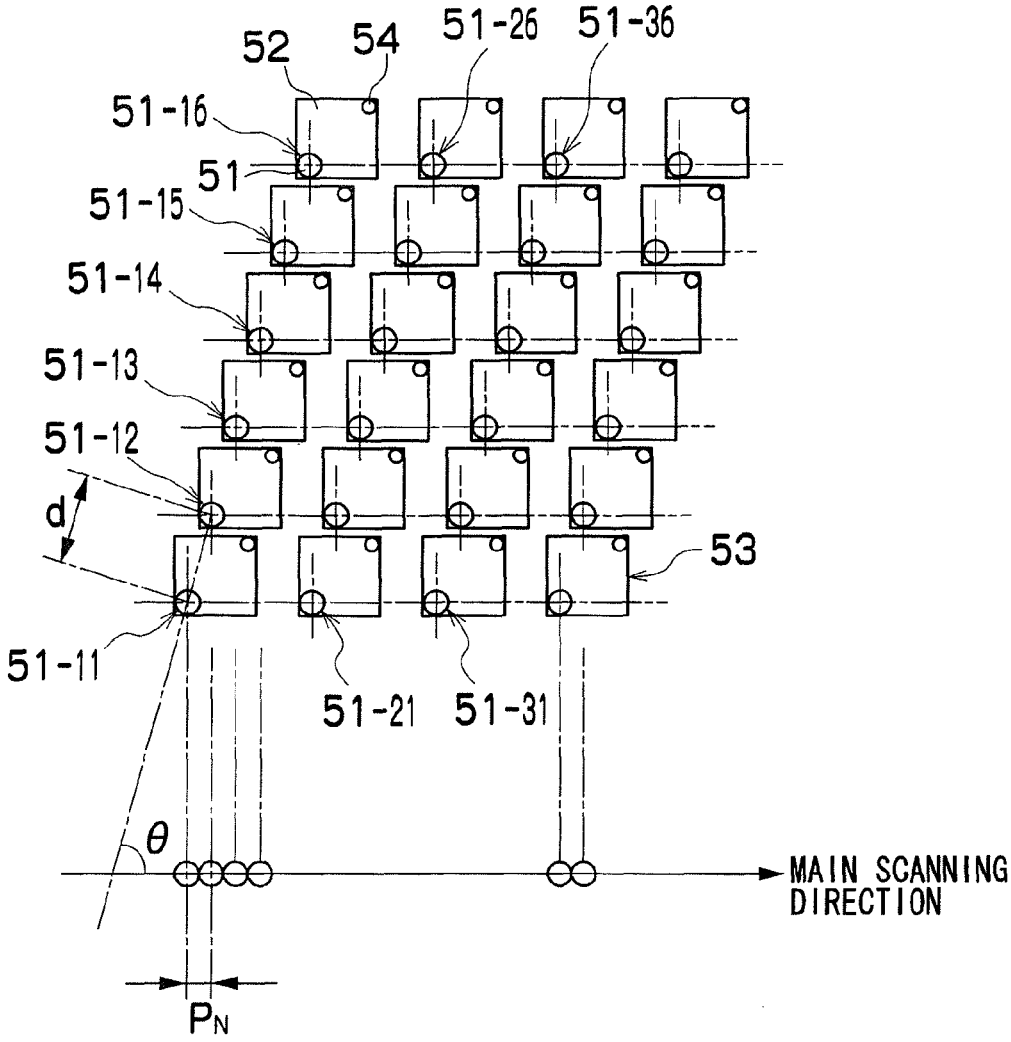
FIG. 5 is an enlarged view showing a nozzle arrangement in the print head shown in FIG. 3A.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch PN of the nozzles projected so as to align in the main scanning direction is d×cos θ, and hence the nozzles 51 can be regarded to be equivalent to those arranged linearly at a fixed pitch PN along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 16 is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Composition of Ink Supply System

Figure 6:
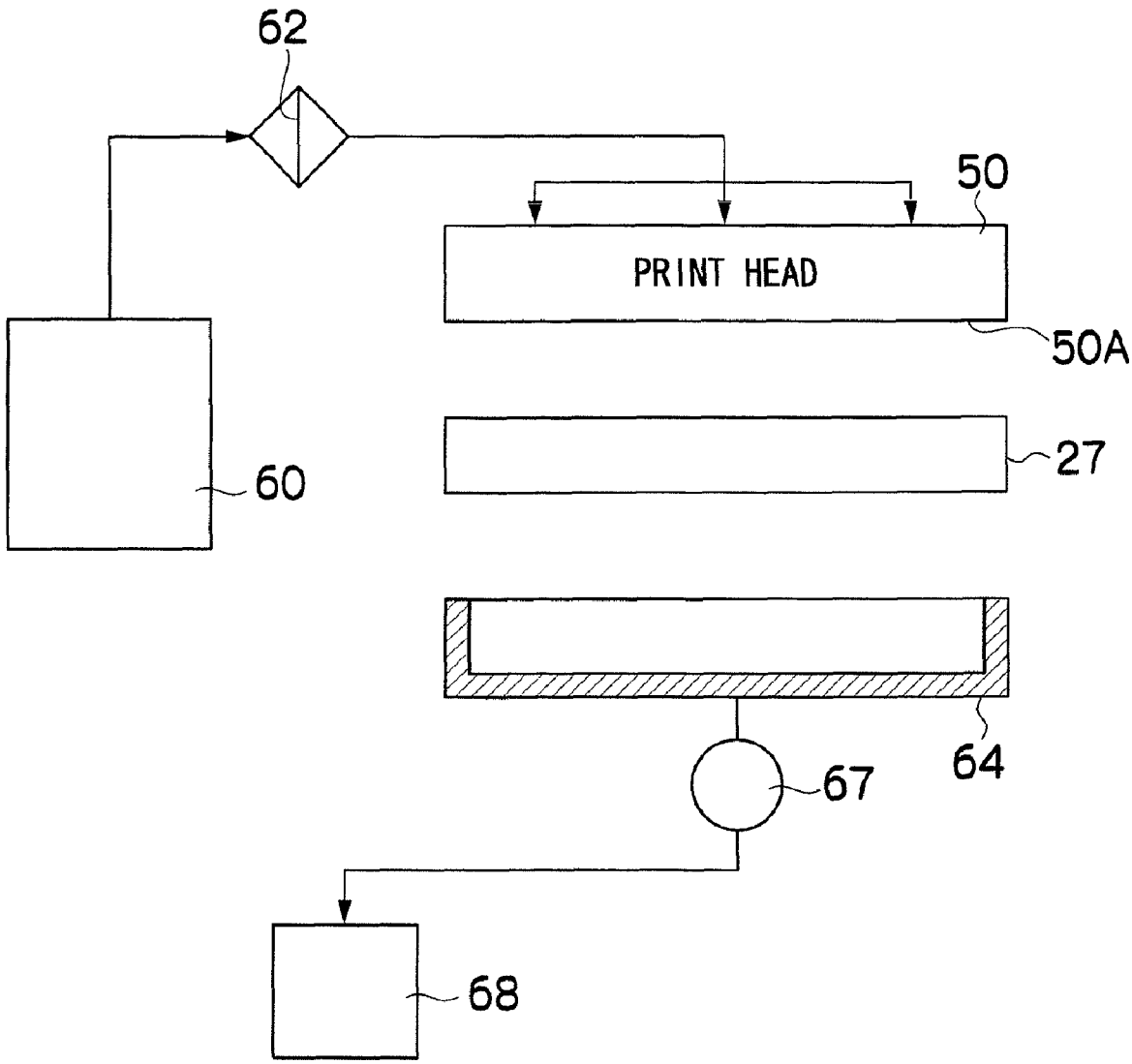
FIG. 6 is a schematic drawing showing the composition of an ink supply system in the inkjet recording apparatus.

FIG. 6 is a schematic drawing showing the configuration of the ink supply system in the inkjet recording apparatus 10. In FIG. 6, the ink tank 60 is a base tank for supplying ink to the print head 50, which is disposed in the ink storing and loading unit 14 shown in FIG. 1. In other words, the ink supply tank 60 in FIG. 6 is equivalent to the ink storing and loading unit 14 in FIG. 1 described above.

The ink tank 60 may adopt a system for replenishing ink by means of a replenishing port (not shown), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

As shown in FIG. 6, a filter 62 for eliminating foreign material and air bubbles is provided at an intermediate position of the tubing which connects the ink tank 60 with the print head 50. Desirably, the filter mesh size is the same as the nozzle diameter in the print head 50, or smaller than the nozzle diameter (generally, about 20 μm). Although not shown in FIG. 6, desirably, a composition is adopted in which a subsidiary tank is provided in the vicinity of the head 50, or in an integrated manner with the head 50. The subsidiary tank has the function of improving damping effects and refilling, in order to prevent variations in the internal pressure inside the head.

Furthermore, the inkjet recording apparatus 10 also comprises a cleaning unit 27 having a wiper (corresponding to a blade member; not shown in FIG. 6) forming a cleaning device for the nozzle surface 50A, and a cap 64 which serves both as a device for preventing drying of the nozzles or preventing increase in the ink viscosity in the vicinity of the nozzles, and as a suctioning device.

A maintenance unit constituted by the cleaning unit 27 and the cap 64 can be moved in a relative fashion with respect to the print head 50 by a movement mechanism (not shown), and is moved from a predetermined withdrawn position to a maintenance position below the print head 50 as required.

As described in detail below, the cleaning unit 27 has the wiper constituted by an elastic member made of rubber, or the like, which can be slid over the ink ejection surface (nozzle surface 50A) of the print head 50, and if ink droplets (ink mist) or foreign material become attached to the nozzle surface 50A, then the nozzle surface 50A is wiped and thus cleaned by sliding this wiper over the nozzle surface 50A.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

During printing or during standby, if the use frequency of a particular nozzle 51 has declined and the ink viscosity in the vicinity of the nozzle 51 has increased, then a preliminary ejection is performed toward the cap 64 (which also serves as an ink receptacle), in order to remove the ink that has degraded as a result of increasing in viscosity.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink of which viscosity has increased in the vicinity of the nozzle toward the ink receptor. After the nozzle surface is wiped and cleaned by a wiper provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, if air bubbles become intermixed into the nozzle 51 or pressure chamber 52, or if the rise in the viscosity of the ink inside the nozzle 51 exceeds a certain level, then it may not be possible to eject ink in the preliminary ejection operation described above. In cases of this kind, a cap 64 forming a suction device is pressed against the nozzle surface 50A of the print head 50, and the ink inside the pressure chambers 52 (namely, the ink containing air bubbles of the ink of increased viscosity) is suctioned by a suction pump 67. The ink suctioned and removed by means of this suction operation is sent to a recovery tank 68. The ink collected in the recovery tank 68 may be used, or if reuse is not possible, it may be discarded.

Since the suctioning operation is performed with respect to all of the ink in the pressure chambers 52, it consumes a large amount of ink, and therefore, desirably, preliminary ejection is carried out while the increase in the viscosity of the ink is still minor. The suction operation is also carried out when ink is loaded into the print head 50 for the first time, and when the head starts to be used after being idle for a long period of time. Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Description of Control System

Figure 7:
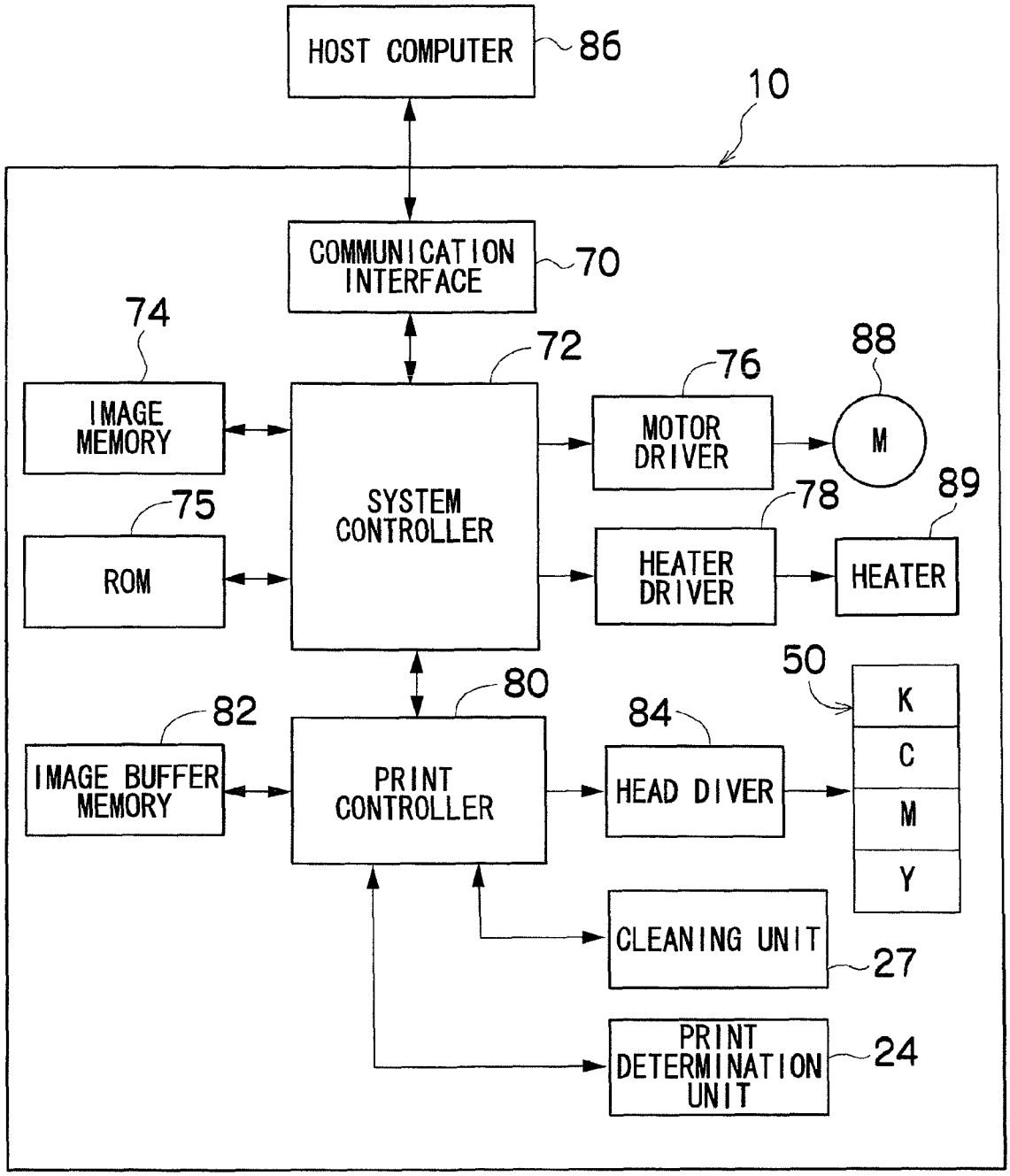
FIG. 7 is a block diagram showing the system composition of the inkjet recording apparatus.

FIG. 7 is a block diagram showing the system composition of the inkjet recording apparatus 10. As shown in FIG. 7, the inkjet recording apparatus 10 comprises a communications interface 70, a system controller 72, a image memory 74, a ROM 75, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74 and ROM 75, and it also generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data (original image data) stored in the image memory 74 in accordance with commands from the system controller 72 so as to supply the generated print data (dot data) to the head driver 84.

The image buffer memory 82 is provided in the print controller 80, and image data, parameters, and other data are temporarily stored in the image buffer memory 82 when image data is processed in the print controller 80. FIG. 7 shows a mode in which the image buffer memory 82 is attached to the print controller 80; however, the image memory 74 may also serve as the image buffer memory 82.

Also possible is a mode in which the print controller 80 and the system controller 72 are integrated to form a single processor.

To give a general description of the sequence of processing from image input to print output, image data to be printed (original image data) is inputted from an external source via a communications interface 70, and is accumulated in the image memory 74. At this stage, RGB image data is stored in the image memory 74, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the image memory 74 is sent to the print controller 80 through the system controller 72, and is converted to the dot data for each ink color by a half-toning technique, such as dithering or error diffusion, in the print controller 80.

In other words, the print controller 80 performs processing for converting the input RGB image data into dot data for the four colors of K, C, M and Y. In this way, the dot data generated by the print controller 80 is stored in the image buffer memory 82.

The head driver 84 outputs drive signals for driving the actuators 58 corresponding to the respective nozzles 51 of the print head 50, on the basis of the print data supplied by the print controller 80 (in other words, the dot data stored in the image buffer memory 82). A feedback control system for maintaining constant drive conditions for the print heads may be included in the head driver 84.

By supplying the drive signals output by the head driver 84 to the print head 50, ink is ejected from the corresponding nozzles 51. By controlling ink ejection from the print heads 50 in synchronization with the conveyance speed of the recording paper 16, an image is formed on the recording paper 16.

As described above, the ejection volume and the ejection timing of the ink droplets from the respective nozzles are controlled via the head driver 84, on the basis of the dot data generated by implementing prescribed signal processing in the print controller 80. By this means, prescribed dot size and dot positions can be achieved.

As shown in FIG. 1, the print determination unit 24 is a block including an image sensor, which reads in the image printed onto the recording paper 16, performs various signal processing operations, and the like, and determines the print situation (presence/absence of discharge, variation in droplet ejection, optical density, and the like), these determination results being supplied to the print controller 80. Instead of or in conjunction with this print determination unit 24, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each pressure chamber 52 of the print head 50, and ejection abnormalities are determined from the determination signals obtained from these pressure sensors when ink is ejected or when the actuators are driven in order to measure the pressure. Alternatively, it is also possible to adopt a mode (external determination method) using an optical determination system comprising a light source, such as laser light emitting element, and a photoreceptor element, whereby light, such as laser light, is irradiated onto the ink droplets ejected from the nozzles and the droplets in flight are determined by means of the transmitted light quantity (received light quantity).

According to requirements, the print controller 80 makes various corrections with respect to the head 50 on the basis of information obtained from the print determination unit 24 or from a further ejection determination device (not shown). Furthermore, the print controller 80 controls the cleaning unit 27 on the basis of information obtained from the print determination unit 24 or a further ejection determination device (not shown), and if an ejection abnormality is determined by the print determination unit 24, or the like, then a cleaning operation (nozzle restoration operation) is carried out, such as preliminary ejection, suctioning, or wiping. This cleaning operation is described in further detail below.

Composition of Cleaning Unit

Figure 8:
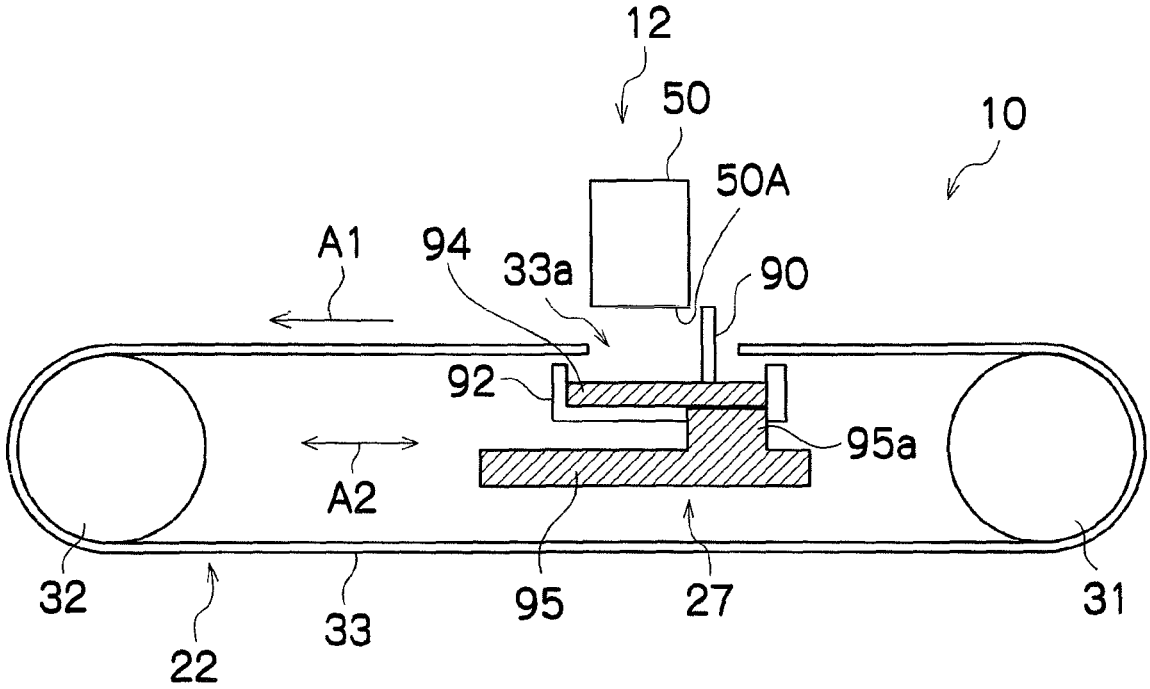
FIG. 8 is an approximate compositional diagram of a cleaning unit incorporated into the inkjet recording apparatus.
Figure 9:
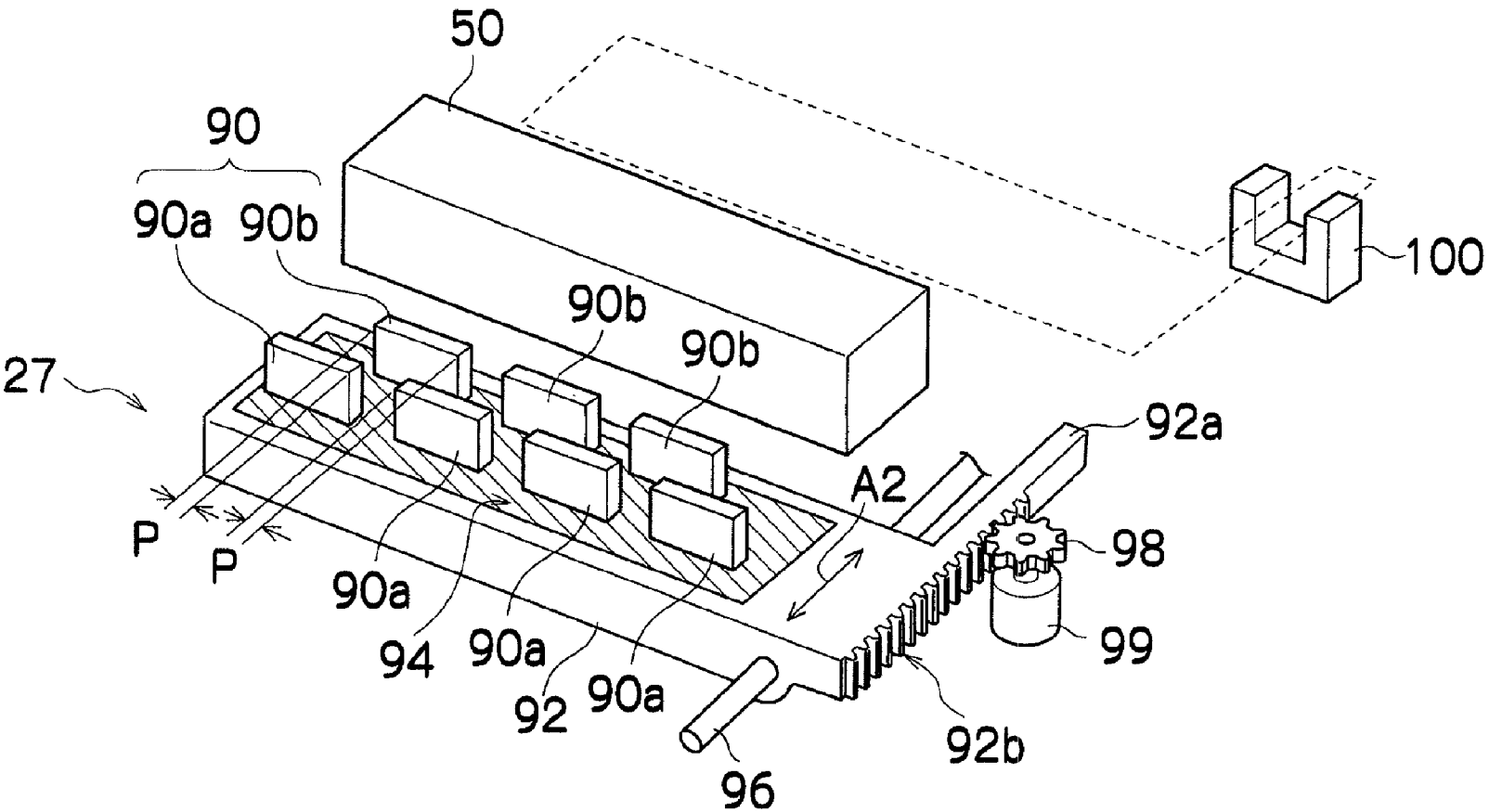
FIG. 9 is an oblique diagram showing the print head and the cleaning unit.

FIG. 8 is an approximate schematic drawing of a cleaning unit 27 incorporated into the inkjet recording apparatus 10, and FIG. 9 is an oblique diagram of the cleaning unit 27. However, FIG. 8 is a simplified diagram which makes the relationship with respect to FIG. 1 easier to understand, and only one print head 50 is depicted in FIG. 8 in order to represent the print heads 12K, 12C, 12M and 12Y in FIG. 1, and furthermore, in practice, the belt conveyance unit 22 also comprises a chamber in the case of vacuum suctioning, or a charging device in the case of electrostatic attraction, or alternatively, a member, such as a platen, in order to kept the recording paper 16 flat in the print unit 12, but these elements are not shown in the diagram.

Furthermore, if the chamber for performing vacuum suction is positioned directly below the belt 33 corresponding to the print unit 12, then the cleaning unit 27 may be provided inside the chamber, or alternatively, a composition may be adopted in which the chamber is withdrawn to another position during cleaning, or instead of this, the cleaning unit 27 is moved to a position directly below the print head 50.

In FIG. 8, the belt 33 rotates in the counterclockwise direction (similarly to FIG. 1) as indicated by the arrow A1, and the recording paper 16 (not shown in FIG. 8) on the belt 33 is moved from right to left in FIG. 8.

As shown in FIG. 8, the cleaning unit 27 is constituted by a wiper (blade member) 90, a wiper tray 92, a first ink suction member 94, a second ink suctioning member 95, and the like. The wiper 90 is installed on a wiper tray 92 and although the detailed structure thereof is described below, it is capable of moving upward and downward in the drawings. The wiper tray 92 is a movable wiper support platform which also serves as a waste liquid recovery device, and it is capable of moving together with the wiper 90 in the rightward and leftward directions in FIG. 8, as indicated by the arrow A2.

An opening section 33*a* for head cleaning is formed in the belt 33. When cleaning is to be performed, the wiper tray 92, together with the wiper 90, is moved to a position directly below the print head 50. When the opening section 33*a* of the belt 33 comes below the print head 50, the wiper 90 is raised up through the opening section 33*a*, and by causing the wiper 90 and the wiper tray 92 to move in synchronism with the movement of the belt 33, the wiper 90 slides over the nozzle surface 50A, thus performing a cleaning action.

When the wiper 90 has performed a cleaning operation up to the end of the nozzle surface 50A, the wiper 90 is lowered to a position where it will not touch the belt 33, and the wiper tray 92 and the wiper 90 are then moved back to their original position (home position).

The ink on the nozzle surface 50A which is wiped away by the wiper 90 flows down along the wiper 90 and is absorbed by the first ink absorbing member 94. Furthermore, the ink ejected by preliminary ejection (purging) on the wiper tray 92 via the opening section 33*a* is absorbed by the first ink absorbing member 94.

When the wiper tray 92 returns to the home position, the first ink absorbing member 94 and the second ink absorbing member 95 abut against a connecting section 95*a* of the second ink absorbing member 95, the ink absorbed by the first ink absorbing member 94 is absorbed by the second ink absorbing member 95 and this ink is accumulated by the second ink absorbing member 95.

FIG. 9 is an oblique diagram of the print head 50 and the cleaning unit 27 in FIG. 8, as viewed from above. In FIG. 9, the belt 33 is omitted from the illustration.

As shown in FIG. 9, the wiper 90 is split into small wipers (split wipers 90*a* and 90*b*) in the lengthwise direction of the nozzle surface 50A of the print head 50, and these wipers are arranged in two rows in the lengthwise direction of the print head 50, at a uniform distance apart. The split wipers 90*a* in the front row and the split wipers 90*b* in the back row are disposed in such a manner that their right and left-hand end sections overlap respectively by P in the lengthwise direction of the print head 50. Furthermore, the split wipers 90A and 90B are supported respectively by independently raisable and lowerable elevator mechanisms (described hereafter with reference to FIG. 11).

The split wipers 90*a* and 90*b* arranged in two rows are disposed so as to cover the full area of the print head 50 in the lengthwise direction (the region of the nozzle rows), as shown in FIG. 9, and these respective split wipers 90*a* and 90*b* are moved in the breadthways direction of the print head 50 (the direction indicated by arrow A2 in FIG. 9), and since the respective split wipers 90*a* and 90*b* are formed so as to be overlapping in the lengthwise direction, then no unwiped areas anse.

On the other hand, a guide shaft 96 is fitted through the wiper tray 92 on which the wipers 90 are mounted, and the wiper tray 92 is supported in a smoothly slidable fashion along the guide shaft 96. One of the end sections 92*a* of the wiper tray 92 extends in the shape of a bar in line with the guide shaft 96, and a linearly shaped tooth section (rack) 92*b* which intermeshes with a toothed wheel (pinion) 98 is formed on the side face of the wiper tray 92.

The toothed wheel 98 which engages with the rank 92*b* is driven by a slider motor (desirably, a stepping motor) 99, and the rack 92*b* (in other words, the wiper tray 92) is movable in the forward or rearward direction as indicated by the arrow A2 in the diagram, due to the rotation of the toothed wheel 98. By means of this rack and pinion mechanism, it is possible to control the position of the wiper tray 92 to a high degree of accuracy in the breadthways direction of the print head 50, by controlling the driving of the slider motor 99.

When cleaning is not being performed, the wiper tray 92 is withdrawn to a withdrawal position (home position) which is indicated by a broken line in the diagram. Furthermore, a home position sensor 100 for detecting that the wiper tray 92 is located in the home position is disposed at a suitable position. A photointerrupter is suitable for use as a home position sensor 100.

Figure 10:
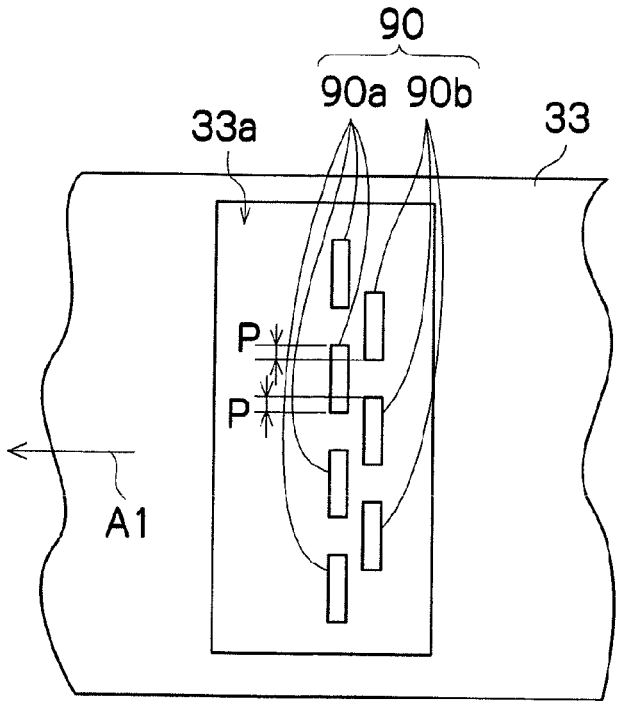
FIG. 10 is a plan diagram showing the relationship between a conveyance belt and a wiper.

FIG. 10 shows the positional relationship between the belt 33 and the wipers 90. An opening section 33*a* is provided in the belt 33, and a structure capable of wiping and cleaning the nozzle surface 50A is achieved by reciprocating the nozzle surface 50A of the print head 50 by raising and lowering the wipers 90 through the opening section 33*a* (in the present embodiment, by moving the wipers 90 in parallel with respect to the nozzle surface 50A). In FIG. 10, a structure capable of wiping and cleaning the nozzle surface 50A as indicated by the arrow is achieved. In FIG. 10, the direction shown by arrow A1 is the conveyance direction of the belt 33, and a cleaning operation (wiping action) is performed in the same direction or in the opposite direction to this, during cleaning by the wipers 90. As stated previously, the split wipers 90*a* in the front row and the split wipers 90*b* in the back row are disposed so that their left-hand and right-hand ends (the upper and lower ends in FIG. 10) are respectively overlapping by P.

Figure 11:
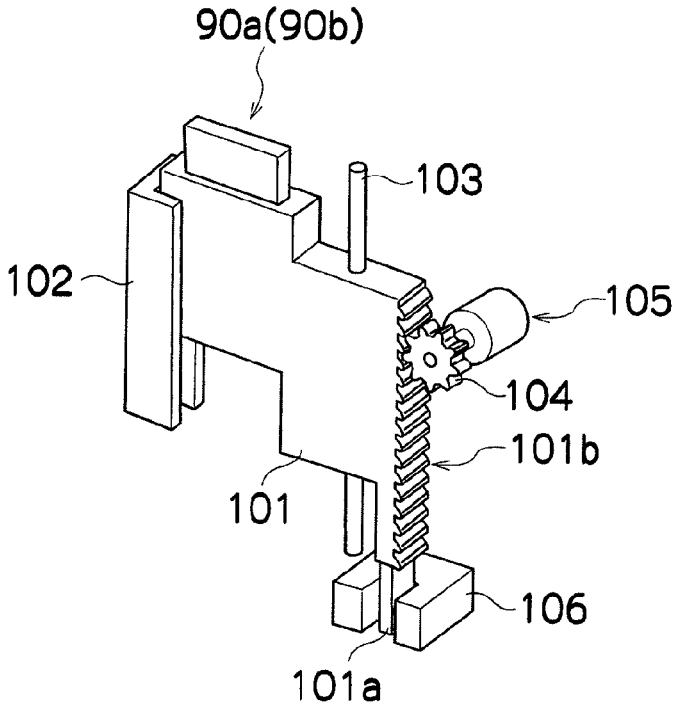
FIG. 11 is an oblique diagram showing an elevator mechanism of the wiper.

FIG. 11 shows one example of the elevator mechanism of a wiper 90 (split wiper 90*a* and 90*b*).

As shown in FIG. 11, the split wiper 90*a* (or 90*b*) is held on a wiper holder (wiper holding member) 101. A guide shaft 103 erected in the upward and downward direction is passed through a wiper holder 101, and one end of the wiper holder 101 (the left-hand side in FIG. 11) engages with a gutter-shaped guide rail 102 erected in the upward and downward direction. Therefore, the wiper holder 101 is able to slide smoothly along the guide shaft 103 and the guide rail 102.

Furthermore, the other end section 101*a* of the wiper holder 101 (namely, the right-hand side in FIG. 11) extends in the shape of a bar, and a linearly shaped toothed section (rack) 101*b* is formed on the side face of the wiper holder 101. A toothed wheel (pinion) 104 which engages with the rack 101*b* can be driven by an elevator motor (desirably, a stepping motor) 105, and the rack 101*b* (in other words, the wiper holder 101) can be moved in the upward and downward direction by rotation of the toothed wheel 104.

Furthermore, the front end section of the bar-shaped end section 101*a* of the wiper holder 101 functions as a light shielding plate which advances to and retreats from the detection position of the home position sensor 106. By driving the toothed wheel 104 by means of the elevator motor 105, with respect to the home position sensor 106, then it is possible to achieve fine positional control (stroke control) of the split wipers 90*a* (90*b*), in the direction (up/down direction) perpendicular to the nozzle surface 50A.

The elevator mechanism shown in FIG. 11 is one example, and the elevator mechanism is not limited to this, but the split wipers 90*a* and 90*b* are able to be raised and lowered respectively and independently.

The split wipers 90*a* (or 90*b*) are each formed by a soft and elastic body, made of rubber or the like, and through repeated use, they gradually wear away and deform, and thus become degraded.

When a wiper 90 has become worn, then even if the wiper 90 is raised or lowered to the same position as when it is in a normal state, during cleaning, the wiper 90 does not make suitable contact with the nozzle surface and therefore a suitable cleaning effect cannot be obtained.

Consequently, in the present embodiment, the amount of wear of the wipers is identified, the amount of raising of the wipers is controlled in accordance with the amount of wear of the wipers, and hence the wipers are reliably made to abut against the nozzle surface.

The cleaning properties of a wiper 90 are dependent on the close contact properties between the wiper 90 and the nozzle surface during cleaning, and the wear characteristics. The main relevant parameters are "contact pressure", "shape of the contact section of the wiper" and "wear characteristics".

The parameters relating to "contact pressure" are the amount of bending (amount of distortion) of the wiper when it is abutted against the nozzle surface, the free length of the wiper, the relative positions of the nozzle surface and the wiper, the vertical coefficient of expansion of the wiper material, the thickness of the wiper, and the like. The parameters relating to the "shape of the contact section of the wiper" are the elastic properties of the tip edge of the wiper, the surface roughness of the edge sections, and the like. The parameters relating to the "wear characteristics" are the coefficient of kinetic friction, the sliding speed, and the like. The coefficient of kinetic friction depends not only on change in the frictional characteristics over time as the wiper is used, but also on the cleaning state (state of wetting), namely, whether wiping is performed in a wet state or in a dry state. Furthermore, the sliding speed is a parameter which affects the generation of cleaning non-uniformities due to a so-called "stick and slip" phenomenon.

In other words, as the number of wiping actions (number of wipes) increases, and the loss of contact pressure and surface roughness also increase, then the contact properties of the wiper member on the nozzle surface decline, and furthermore, the wiping member tends to become hard and cleaning properties decline.

With respect to these issues, in the embodiments of the present invention, in order to maintain and restore the cleaning properties, the current cleaning capability is identified by means of a wiper cleaning capability identification device (for example, either one or suitable combination of an amount of wear estimation device, a contact pressure determination device, and a vibration determination device). A device is disclosed which restores cleaning properties by controlling a cleaning capability restoring device, on the basis of the identification results (the data determined by the cleaning capability identification device), and furthermore, a control method for improving cleaning functions by utilizing this device is proposed. These specific devices are described below.

EXAMPLE 1

Mode Using Device for Identifying Amount of Wear of Wiper

As a method for identifying the amount of wear of the wiper, it is possible to use one of the following methods, for example.

Figure 12:
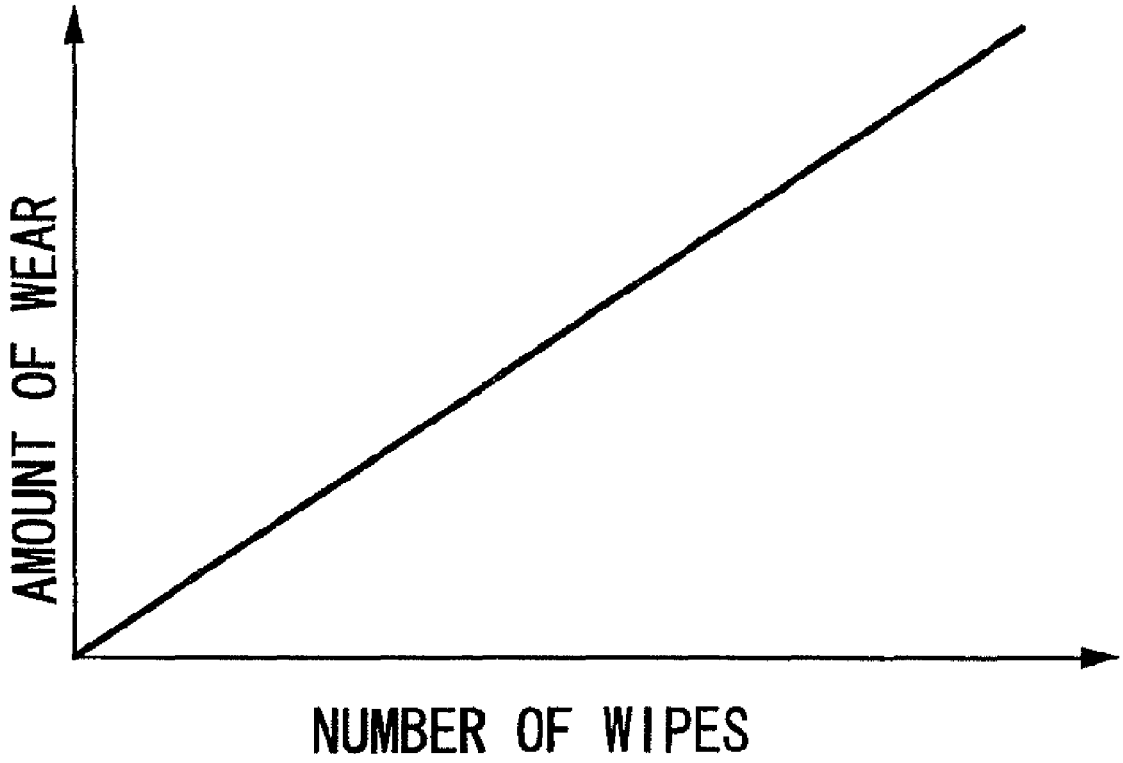
FIG. 12 is a graph showing the correlation between the amount of wear of the wiper and the number of wipes.

More specifically, correlation data for the number of wipes and the amount of wear of the wiper, such as that shown in FIG. 12, is previously stored, the number of wipes is counted each time cleaning is performed, and the amount of wear of the wiper is calculated (inferred) from the counted number of wipes, on the basis of the aforementioned correlation data.

When used in an actual apparatus, the amount of wear of the wiper is calculated from the aforementioned correlation data, each time a previously established number of wipes is performed, and the amount of feed (wiper raising amount) from the home position based on the home position sensor 106 performed by the wiper elevator mechanism shown in FIG. 11 is corrected on the basis of previously established data which similarly indicates the relationship between the amount of wear of the wiper and the raising amount of the wiper.

In this way, by finding the raising amount (stroke) for the wiper in accordance with the amount of wear of the wiper, and then raising the wiper accordingly, it is possible to make the wiper abut against the nozzle surface at a contact pressure that is suitable for cleaning. Accordingly, it is possible to ensure cleaning properties by maintaining stable close contact between the wipers and the nozzle surface at all times, even if the wipers are worn.

Furthermore, in this case, it is possible for the correlation data between the number of wipes and the amount of wear to be held as a plurality of sets of data, for wet wiping, dry wiping, and variations in the contact pressure, in such a manner that an amount of wear corresponding to the respective number of wipes is calculated.

To achieve a state where a clearance is provided between the nozzle surface 50A and the wiper 90, the wiper 90 is initially raised, and then the feed is controlled in the downward direction, from the position where the prescribed pressure (pressure during contact) is detected, and the wiper is halted at a prescribed clearance (after a specified feed amount).

Furthermore, the raised position at which the prescribed pressure is detected can be stored with respect to the home position of the wiper 90, and the raised position of the wiper 90 can be controlled with reference to the feed amount to that position. In this case, the reference value for the feed amount is updated after each prescribed number of wipes.

Alternatively, it is also possible to store the relationship between the contact pressure and the contact stroke in the form of a table, and to control the position in the direction perpendicular to the nozzle surface 50A on the basis of this table.

Figure 13:
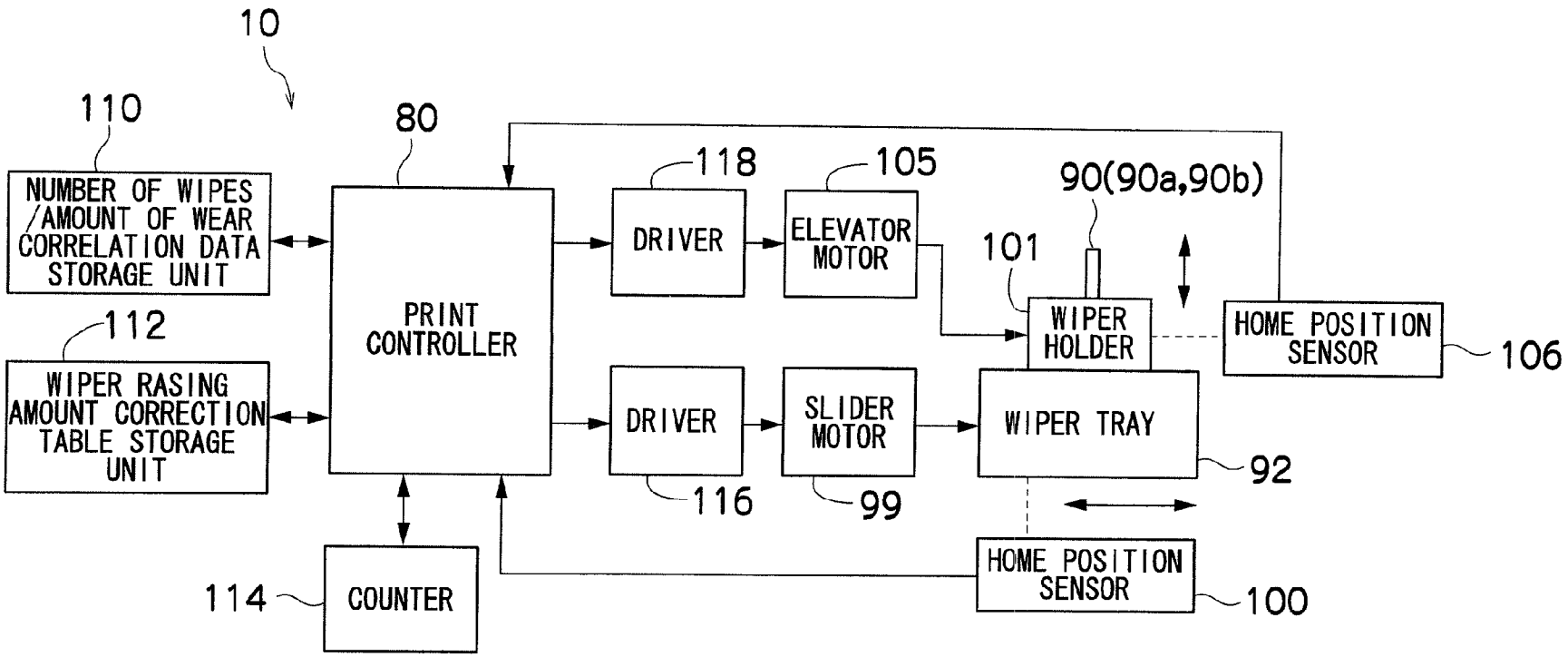
FIG. 13 is a principal block diagram showing an example of the composition of a control system of the inkjet recording apparatus.

FIG. 13 is a principal block diagram showing an example of the composition of a control system which implements the method described above. As shown in FIG. 13, the inkjet recording apparatus 10 comprises: a storage unit (hereafter, called "correction data storage unit") 110 which stores correlation data for the number of wipes and the amount of wear of the wiper; a storage unit (hereafter, called "correction table storage unit") 112 which stores a correction table for the raising amount of the wiper, in accordance with the amount of wear; a counter 114 for counting the number of wipes; and drivers (drive circuits) 116 and 118 for respectively driving the slider motor 99 and the elevator motor 105. For the correlation data storage unit 110 and the correction table storage unit 112, it is suitable to use a non-volatile storage device, such as an EEPROM, or alternatively, a region of the ROM 75 shown in FIG. 7 may be used for these storage units.

The print controller 80 controls the driving of the slider motor 99 and the elevator motors 105, via the drivers 116 and 118 and thus controls the position of the wiper tray 92 and the wiper holders 101 (in other words, the position of the wipers 90). The respective home positions of the wiper tray 92 and the wiper holders 101 are determined by the home position (HP) sensors 100 and 106, as described above with respect to FIG. 9 and FIG. 11, and these determination signals are reported to the print controller 80 as shown in FIG. 13.

The print controller 80 controls the amount of drive of the slider motor 99 and the elevator motors 105 (the number of pulses in the case of stepping motors), with respect to the respective home positions. Furthermore, the print controller 80 updates the count value of the counter 114 when a wiping operation is performed, and also reads in the count value from the counter 114, at a suitable timing.

By means of the illustrated composition, the counter 114 increments the count value each time a wiping operation is performed, and when the count reaches the prescribed number of wipes, it determines the amount of wear of the wiper for that number of wipes, from the correlation data held in the correlation data storage unit 110. A correctional value for the raising amount of the wiper corresponding to the amount of wear of the wiper thus identified is found from the data in the correction table storage unit 112, and the raised position of the wiper 90 during wiping is corrected accordingly.

FIG. 13 shows an example in which correlation data and a corrective table are stored, but it is also possible to integrate these and to use a table which associates numbers of wipes with correctional values for the wiper raising amount. Furthermore, instead of the correction table storage unit 112, it is also possible to adopt a mode where a calculation processing unit is provided which calculates a correction value for the wiper raising amount from the amount of wear of the wiper, by using a suitable calculation formula. Of course, this calculation processing unit may be achieved by using the calculation functions of the system controller 72 shown in FIG. 7.

EXAMPLE 2

Mode Using Contact Pressure Determination Device

Figure 14:
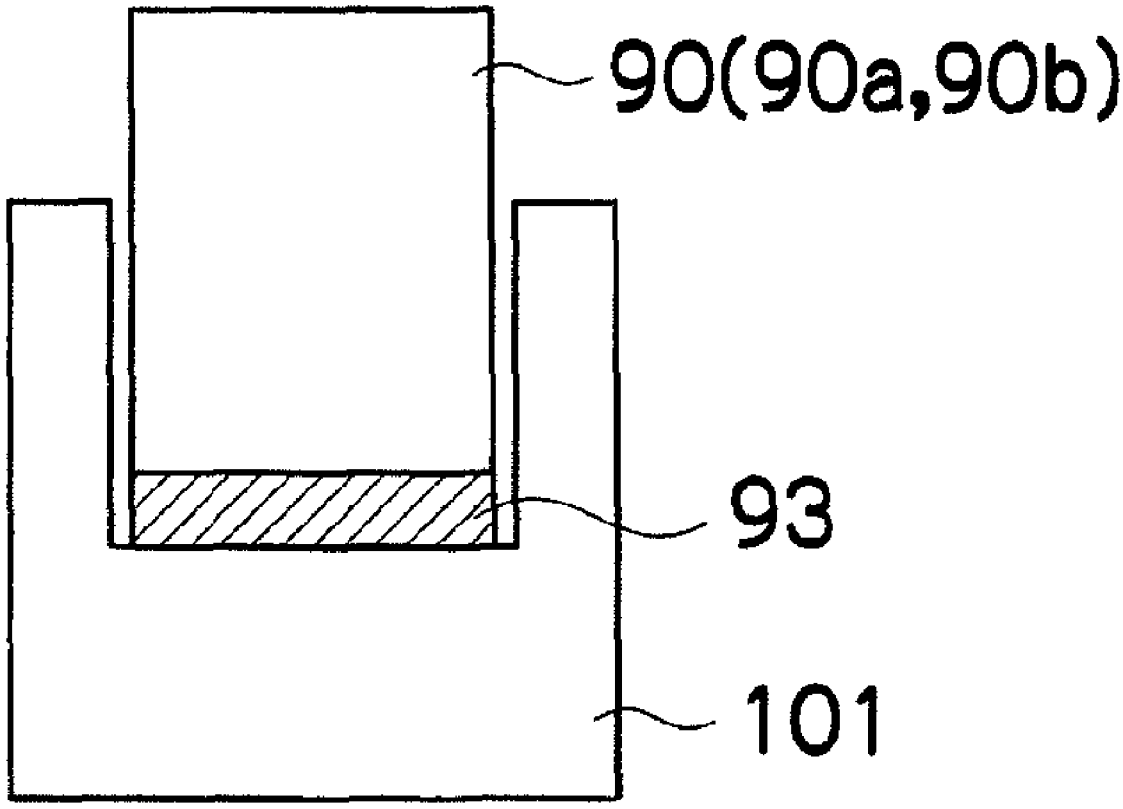
FIG. 14 is an illustrative diagram showing a situation where a pressure determination device is provided between the wiper and the wiper holder.

As a further method for identifying the amount of wear of the wiper 90, it is also possible to introduce a pressure determination device, such as a piezoelectric element 93, between the wiper 90 and the wiper holder 101, as shown in FIG. 14, for example, and to identify the amount of wear by determining the pressure (contact pressure) created when the wiper 90 abuts against the nozzle surface 50A, by means of this pressure determination device (piezoelectric element 93).

More specifically, the wiper 90 (90*a* or 90*b*) is fed and controlled in the raising direction, from the home position, by means of the wiper elevator mechanism shown in FIG. 11, and during this operation, the pressure is determined by the piezoelectric element 93 (see FIG. 14) in the wiper holder 101, feeding is halted at a point where the pressure reaches a previously established prescribed pressure, and the wiper is thus set to a raising amount corresponding to the amount of wear. In this way, it can be regarded that the raising amount is determined by directly measuring the amount of wear of the wiper.

Figure 15:
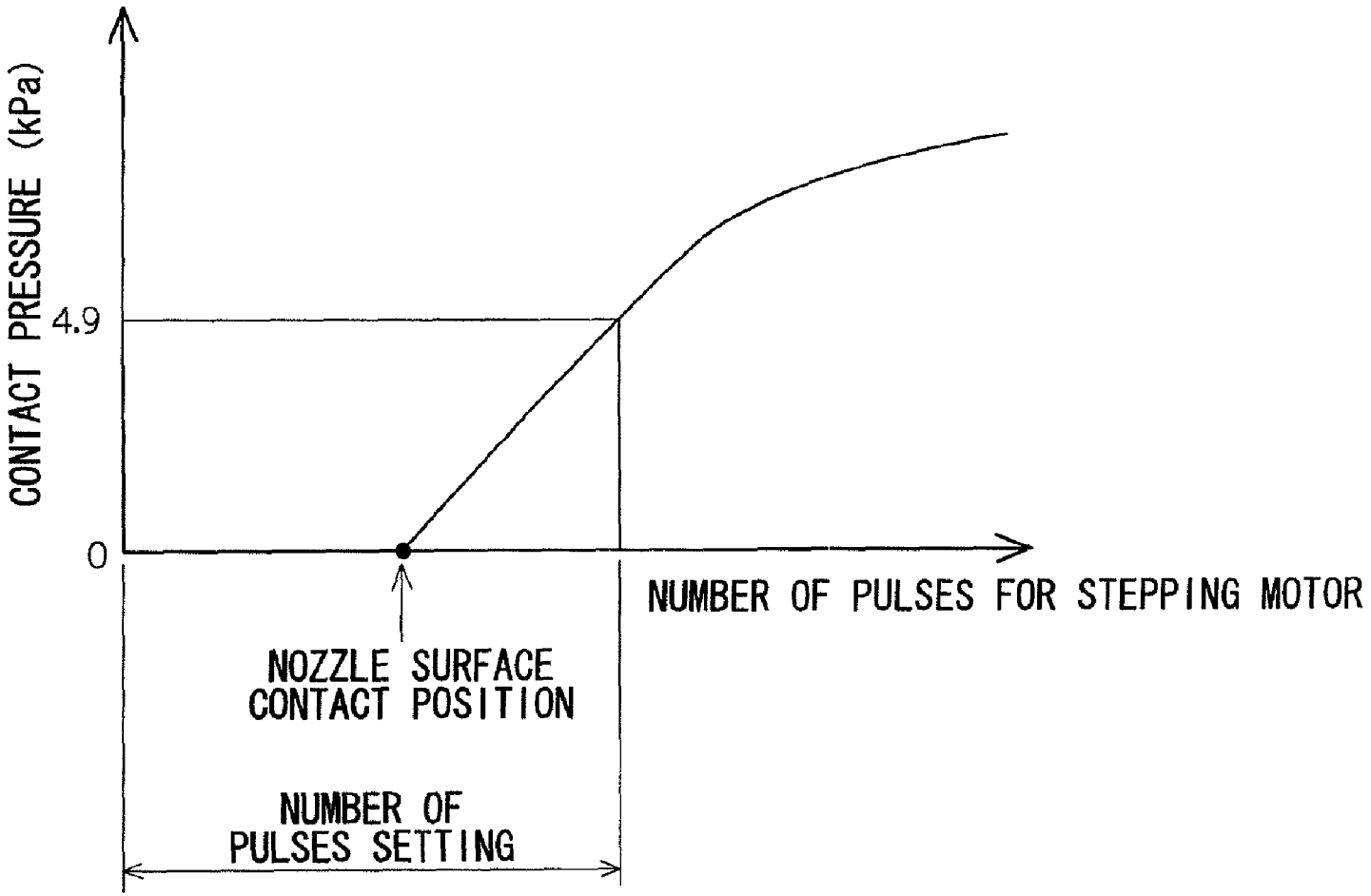
FIG. 15 is a graph showing an example of the relationship between the number of pulses for an elevator motor and the contact pressure.

FIG. 15 shows a corresponding example. In FIG. 15, the horizontal axis indicates the number of pulses for the elevator motor (stepping motor) 105, with reference to the home position (point of origin), and the vertical axis indicates the contact pressure (kPa) of the wiper 90 as determined by the piezoelectric element 93.

The elevator motor 105 is rotated in the raising direction from the home position, by means of the wiper elevator mechanism (see FIG. 11), and the number of pulses from the home position until the contact pressure comes within a suitable pressure range is counted up, as shown in FIG. 15, and this number of pulses is set as a raising target position and is stored.

FIG. 15 shows an example where the number of pulses at which the contact pressure becomes 4.9 kPa (≈50 gf/cm$^2$) is established, but the target contact pressure (specified pressure) may be set to another suitable value. However, a desirable range for the suitable pressure is 0.49 kPa to 4.9 kPa (5 gf/cm$^2$ to 50 gf/cm$^2$).

EXAMPLE 3

Mode Using Vibration Determination Device

Figure 16A:
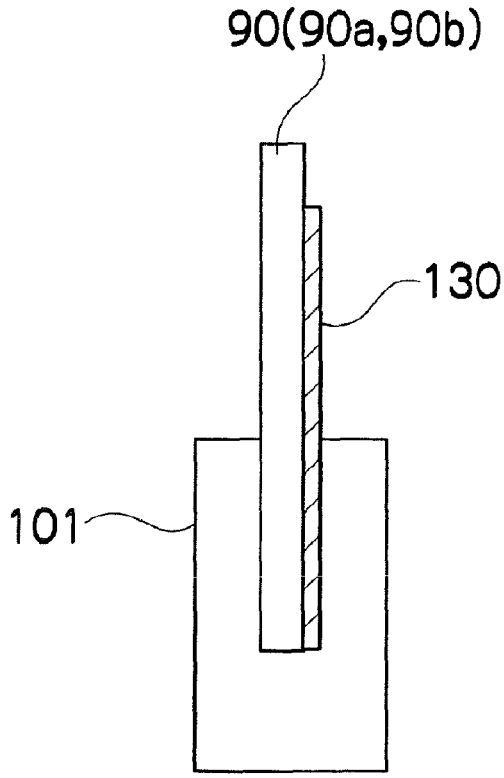
FIG. 16A is a compositional diagram showing an example in which a distortion gauge is appended to a wiper.

As shown in FIG. 14, by adopting a composition in which a piezoelectric element 93 is provided on the base end section of the wiper 90, it is possible to determine the vibration of the wiper 90 during a sliding operation, by means of the piezoelectric element 93. However, the mode of the vibration determination device is not limited to the example shown in FIG. 14, and as shown in FIG. 16A, it is also possible to adopt a composition in which a distortion gauge 130 patterned in the form of a sheet is attached to a side face on one side (or both sides) of the wiper 90. The amount of bending (amount of distortion) in the wiper 90 can be determined by this distortion gauge 130.

Figure 16B:
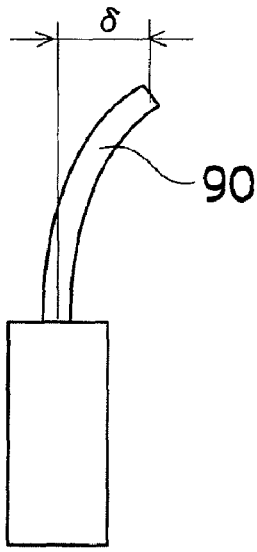
FIG. 16B is an illustrative diagram used to describe the definition of the amount of distortion due to bending deformation of the wiper.

For example, as shown in FIG. 16B, it is possible to define the amount of displacement δ of the tip of the wiper, from the center line of the fixed section of the wiper 90, due to bending, as the "amount of distortion". Furthermore, the change over time of the amount of distortion δ is determined as the vibration.

Figure 17:
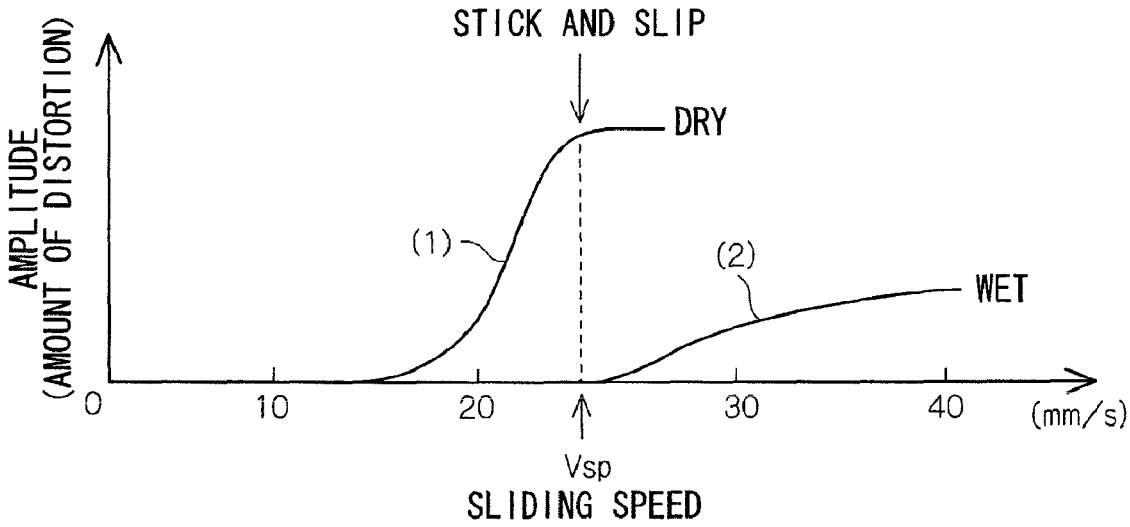
FIG. 17 is a graph showing the relationship between the sliding speed and the amount of distortion (amplitude) of the wiper.

FIG. 17 is a graph showing the relationship between the sliding speed of the wiper 90 and the amount of distortion (amplitude) of the wiper 90. The horizontal axis indicates the sliding speed (mm/s) and the vertical axis indicates the amplitude of the wiper (the pressure variation in the sensor output). FIG. 17 depicts two graphs: (1) a graph in a case where wiping is performed in a dry state, and (2) a graph in a case where wiping is performed in a wet state.

As shown in FIG. 17, the relationship between the sliding speed and the amplitude of the wiper varies greatly depending on the state of wetting of the nozzle surface, and the dry state produces a larger vibration (amplitude) than the wet state. Furthermore, the vibration increases if the contact pressure is increased, and the vibration also increases, if the sliding speed is increased.

Figure 18:
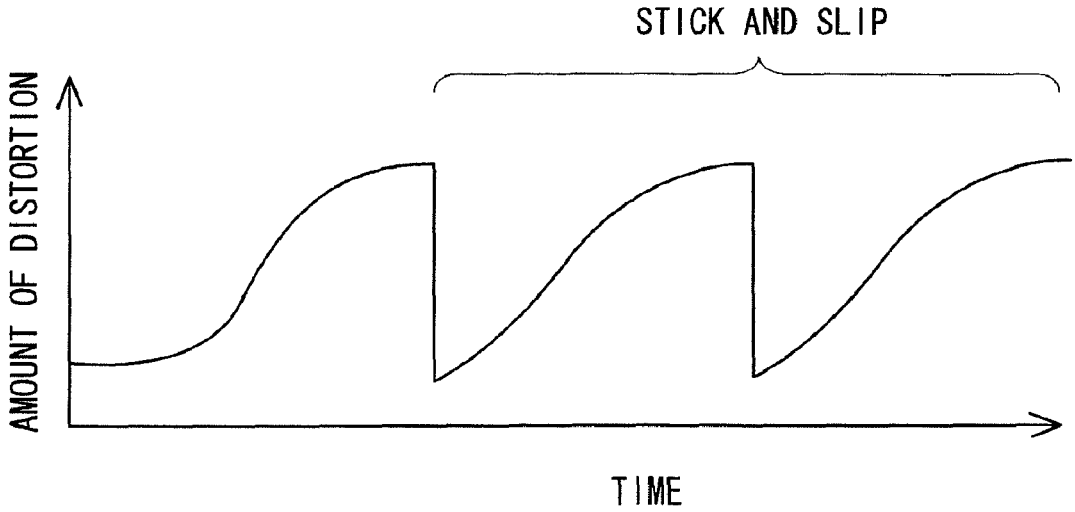
FIG. 18 is a graph showing the movement of the wiper when a stick and slip phenomenon occurs.

In particular, in a dry state, if the sliding speed exceeds a certain limit (Vsp in FIG. 17), then a stick and slip phenomenon occurs and wiping non-uniformities arise on the nozzle surface. FIG. 18 is a graph showing the movement of the wiper when a stick and slip phenomenon occurs. The horizontal axis indicates time and the vertical axis indicates the amount of bending (amount of distortion) of the wiper.

When a stick and slip phenomenon occurs, as shown in FIG. 18, the amplitude of the wiper increases and the wiper repeats a vibration having a point of discontinuity where the amount of distortion of the wiper suddenly returns to its original value. If the contact pressure varies due to wiper vibration of this kind, then stable wiping cannot be achieved. This phenomenon is particularly marked when wiping in a dry state, whereas in a wet state, the coefficient of friction is low, and therefore, "stick and slip" is not liable to occur, even if the sliding speed is raised.

In view of the foregoing circumstances, at least one of the relative speed between the nozzle surface and the wiper (namely, the sliding speed), the relative position of the wiper with respect to the nozzle surface (namely, the contact pressure), and the state of wetting between the nozzle surface and the wiper, is controlled in such a manner that the vibration of the wiper when sliding over the nozzle surface (during wiping) comes within a permissible range of vibration.

The relative speed between the nozzle surface and the wiper can be controlled by controlling the drive frequency of the slider motor (here, a stepping motor) 99 shown in FIG. 9. The relative position between the wiper and the nozzle surface can be controlled by controlling the elevator motor 105 shown in FIG. 11 (for example, by establishing the number of pulses from the home position). The state of wetting between the nozzle surface and the wiper can be controlled by ejecting, or omitting to eject, ink from the nozzles of the head onto the tip portion of the wiper, and by controlling the volume of ink thus ejected.

Figure 19:
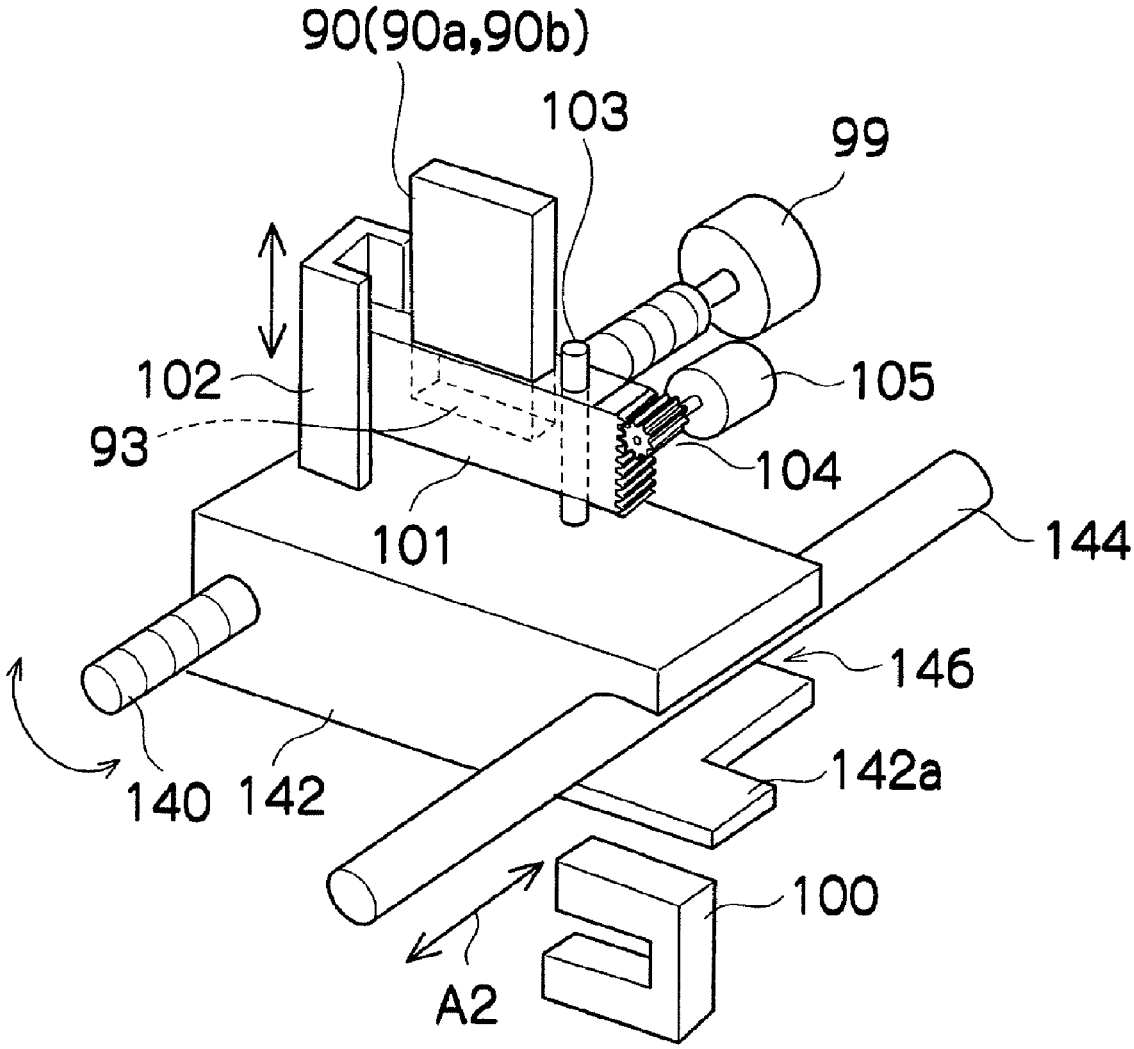
FIG. 19 is a principal oblique diagram showing a further example of the composition of a wiper slider and elevator mechanism.

FIG. 19 shows a further example of the composition of a wiper slider and elevator mechanism. In this diagram, elements which are the same as or similar to the compositional example in FIGS. 9 to 14 are denoted with the same reference numerals and description thereof is omitted here.

In FIG. 9, a rack 101*b* and a toothed wheel (pinion) 98 are used as a sliding mechanism for the wiper tray 92, but in the example shown in FIG. 19, a sliding mechanism based on a ball screw mechanism (or a lead screw mechanism) using a screw shaft is adopted.

In other words, the rotating axle of the slider motor 99 is coupled to a suitable coupling shaft 140, via a suitable coupling (not shown). A support platform 142 (corresponding to the wiper tray 92 in FIG. 9) on which a wiper holder 101 is mounted, screws onto the screw shaft 140 as shown in FIG. 19. Furthermore, a slide guide 144 is disposed in parallel with the screw shaft 140, and a coupling recess section 146 formed on the end section of the support platform 142 engages slidably with the slide guide 144.

When the slider motor 99 is driven and the screw shaft 140 is caused to rotate, the support platform 142 moves smoothly in the axial direction of the screw shaft 140 (the direction indicated by arrow A2 in FIG. 19), while the support platform 142 is prevented from rotating by means of the slide guide 144.

The home position of the support platform 142 can be identified by means of a light shielding plate section 142*a* provided in a projecting manner on the end section of the support platform 142 being detected by the home position sensor 100 (for example, a photointerrupter).

Figure 20:
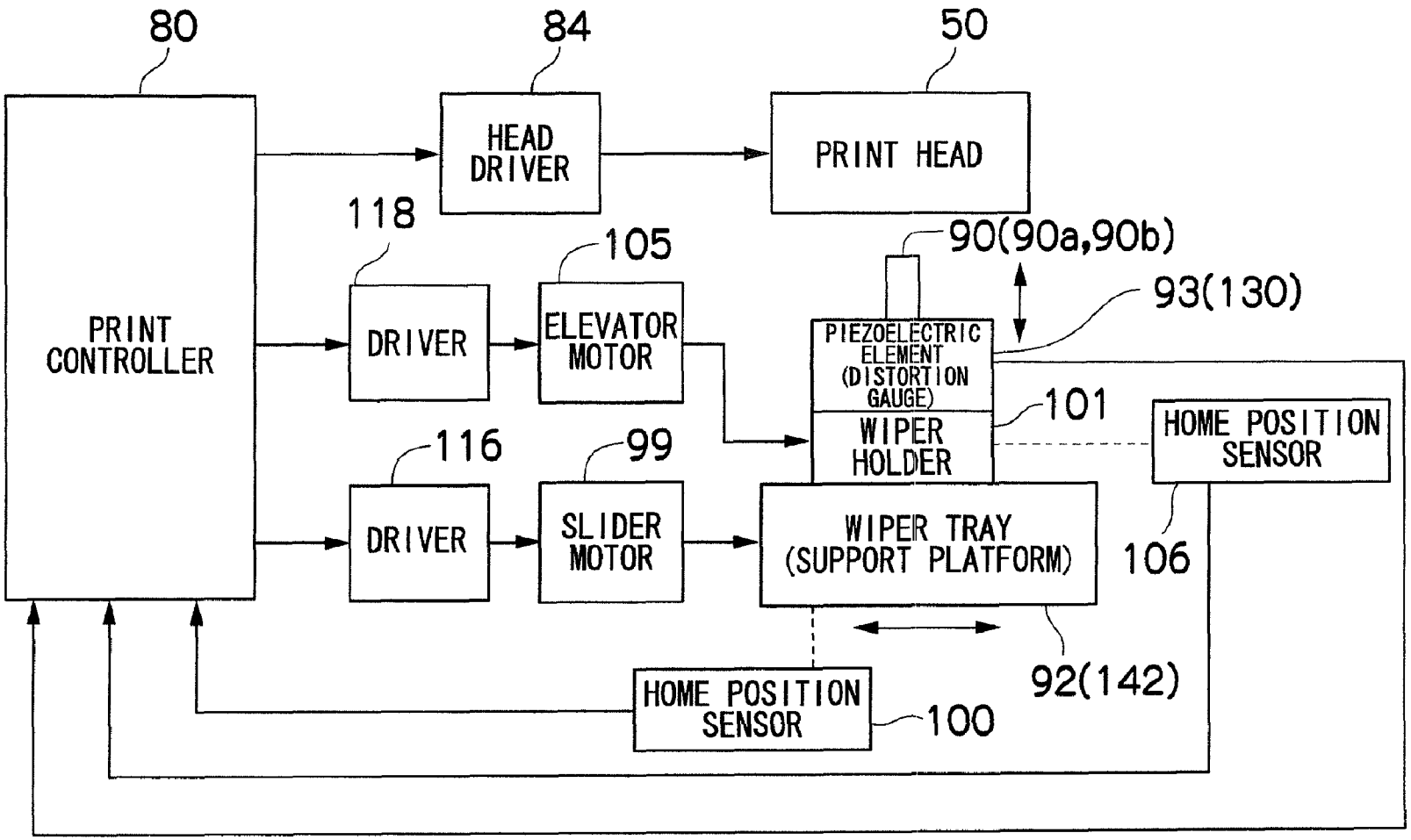
FIG. 20 is a principal block diagram showing an example of the composition of a control system in a case where a vibration determination device is used.

FIG. 20 is a principal block diagram showing an example of the composition of a control system in a case where the aforementioned vibration determination device is used. In FIG. 20, elements which are the same as or similar to the compositional example in FIGS. 7 to 19 are denoted with the same reference numerals and description thereof is omitted here.

As shown in FIG. 20, the determination signal determined by the piezoelectric element 93 (or distortion gauge 130) provided in order to determine vibration of the wiper 90 is supplied to the print controller 80. The print controller 80 controls at least one of the drive frequency of the slider motor 99, the amount of rotation (number of steps) of the elevator motor 105, and an ink ejection operation from the print head 50, in such a manner that the vibration of the wiper 90 when sliding over the nozzle surface (during wiping) comes within a prescribed suitable vibration range, on the basis of this determination signal.

More specifically, the print controller 80 in the diagram functions as a relative speed control device, a relative position control device and a wet state control device. Similarly to the example shown in FIG. 13, the method for associating the determination results from the piezoelectric element 93 with the respective control values (such as the correction values, target control values, set values, and the like), is either a method which uses suitable correlation data or a correction table, or a method which uses a calculation algorithm, or the like.

Instead of the print controller 80, it is also possible for the system controller 72 shown in FIG. 7 to take on the role of the relative speed control device, the relative position control device and the wet state control device, and furthermore, these control operations may be performed conjointly by the print controller 80 and the system controller 72. Alternatively, the print controller 80 and the system controller 72 may share the control items, in a suitable fashion (this point also applies to Examples 4 to 13 described below).

EXAMPLE 4

Mode Using Frictional Force Measurement Device

As a further device for identifying the cleaning capability, it is possible to use a device which measures the frictional force between the wiper and the nozzle surface, the relative positions of the nozzle surface and the wiper being adjusted in such a manner that the frictional force comes within a suitable range of values.

For example, if a DC motor is used as the slider motor 99, then by measuring the current value of the motor during a wiping operation (during sliding), it is possible to identify the frictional force (force of kinetic friction) between the wiper and the nozzles surface.

Figure 21:
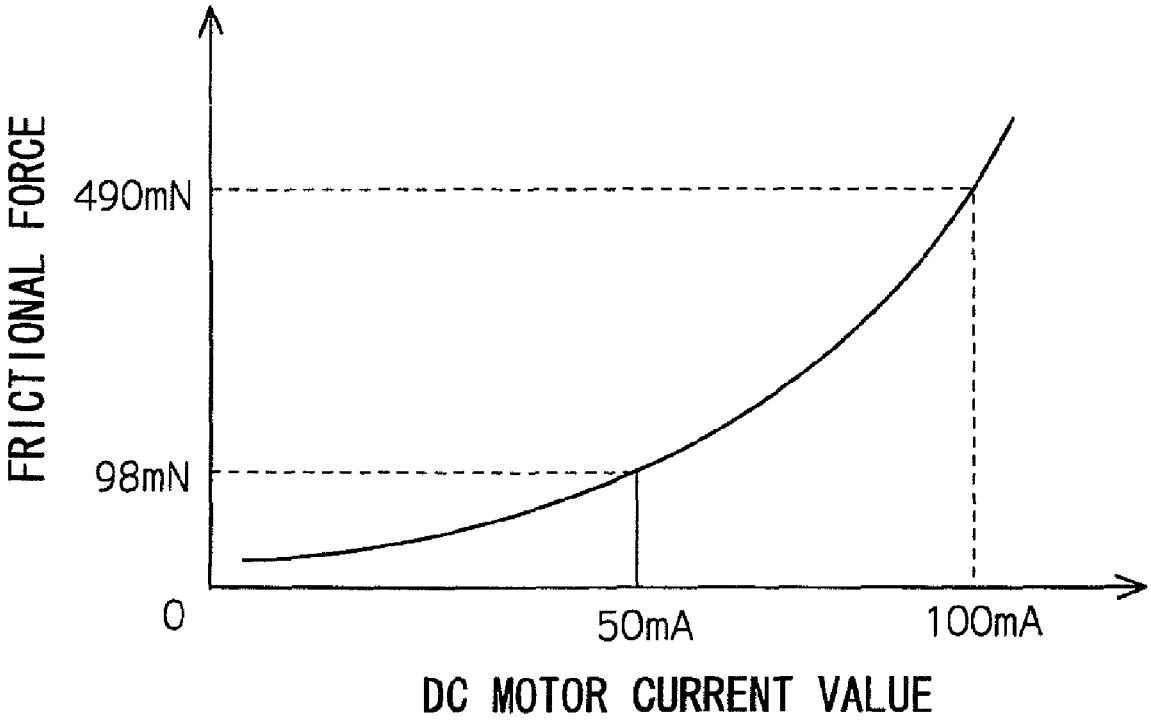
FIG. 21 is a graph showing an example of the relationship between the current value of the DC motor and the frictional force.

FIG. 21 is a graph showing an example of the relationship between the current value of the DC motor and the frictional force. The numerical values shown in the drawing are provided for the sake of illustration, and they vary depending on conditions, such as the type of motor actually used, the composition of the motive force transmission system, the material and structure of the wipers, and the like.

The burden on the slider motor 99 varies depending on the magnitude of the frictional force between the wiper 90 and the nozzle surface, and since it displays a correlation such as that in FIG. 21, for example, then by storing the relevant correlation data and measuring the current value of the slider motor 99, it is possible to identify (infer) the frictional force from the current value.

Figure 22:
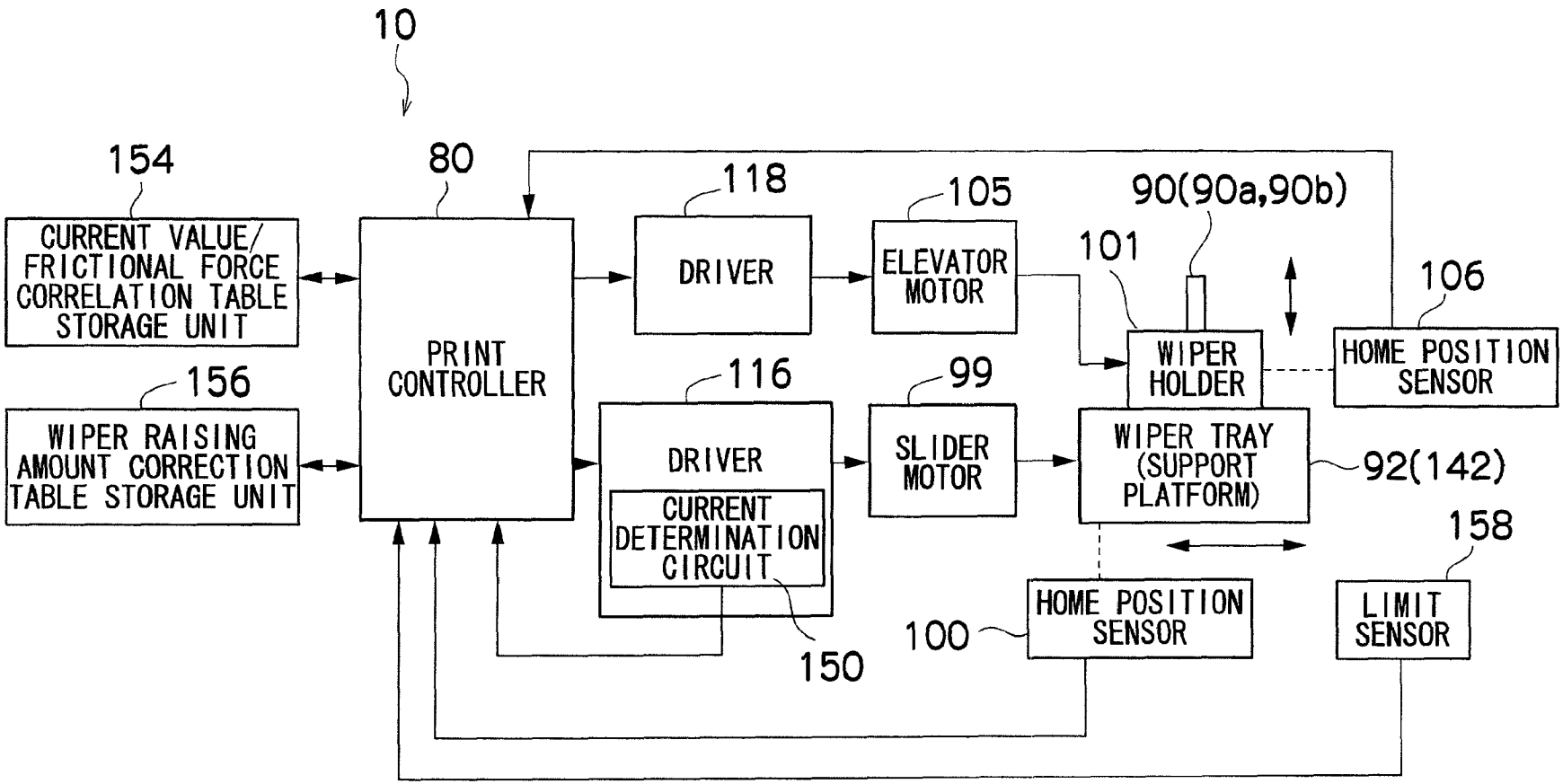
FIG. 22 is a principal block diagram showing an example of the composition of a control system in a case where a DC motor is used as the slider motor.

FIG. 22 shows a principal block diagram of a control system which achieves the foregoing. In FIG. 22, elements which are the same as or similar to the compositional example in FIGS. 7 to 20 are denoted with the same reference numerals and description thereof is omitted here. In FIG. 22, a DC motor is used as a slider motor 99, and an electrical determination circuit 150 for determining the drive current is provided in the driver 116 for driving the motor.

Furthermore, the inkjet recording apparatus 10 according to the present embodiment comprises a storage unit for storing correlation data for the current value and frictional force such as that in FIG. 21 (this unit is indicated by reference numeral 154 in FIG. 22), and a storage unit 156 for storing a correctional table for the wiper raising amount (the relative position of the wiper 90 with respect to the nozzle surface) in accordance with the frictional force.

With a DC motor, the position cannot be controlled by means of the number of pulses, as in a stepping motor, and therefore, in order to restrict the range of movement of the wiper tray 42 (or the support platform 142) (in other words, the wiper sliding range), a limit sensor 158 is disposed at the end position of the range of permitted movement, in addition to the home position sensor 100. The determination signal from the limit sensor 158 is supplied to the print controller 80.

The print controller 80 drives the slider motor 99 with reference to the home position in order to slide the wiper 90, and when it is detected from the determination signal of the limit sensor 158 that the end position has been reached, then the wiping is halted. If the sliding direction of the wiper 90 is reversed, then the system is adapted by switching the roles of the limit sensor 158 and the home position sensor 100.

The current value is measured by the current determination circuit 150 during driving of the slider motor 99 (in other words, during sliding operation of the wiper), and information on the current value thus obtained is supplied to the print controller 80.

The print controller 80 determines the frictional force from the correlation data in the storage unit 154, on the basis of the information on the current value obtained by the current determination circuit 150. A correctional value for the raising amount of the wiper corresponding to the frictional force thus identified is found from the correction table in the storage unit 156, and the raised position of the wiper 90 is corrected accordingly.

FIG. 22 shows an example in which correlation data and a corrective table are stored, but it is also possible to integrate these and to use a table which associates current values with correctional values for the wiper raising amount, and in this respect, the present embodiment sis similar to that shown in FIG. 13.

As a further method for identifying the frictional force between the wiper and the nozzle, it is also possible to use the correlation between the amount of distortion of the wiper and the frictional force. For example, as shown in FIG. 16A, the amount of distortion δ of the wiper (see FIG. 16B) is measured by means of a composition in which a distortion gauge 130 is appended to the wiper 90.

Figure 23:
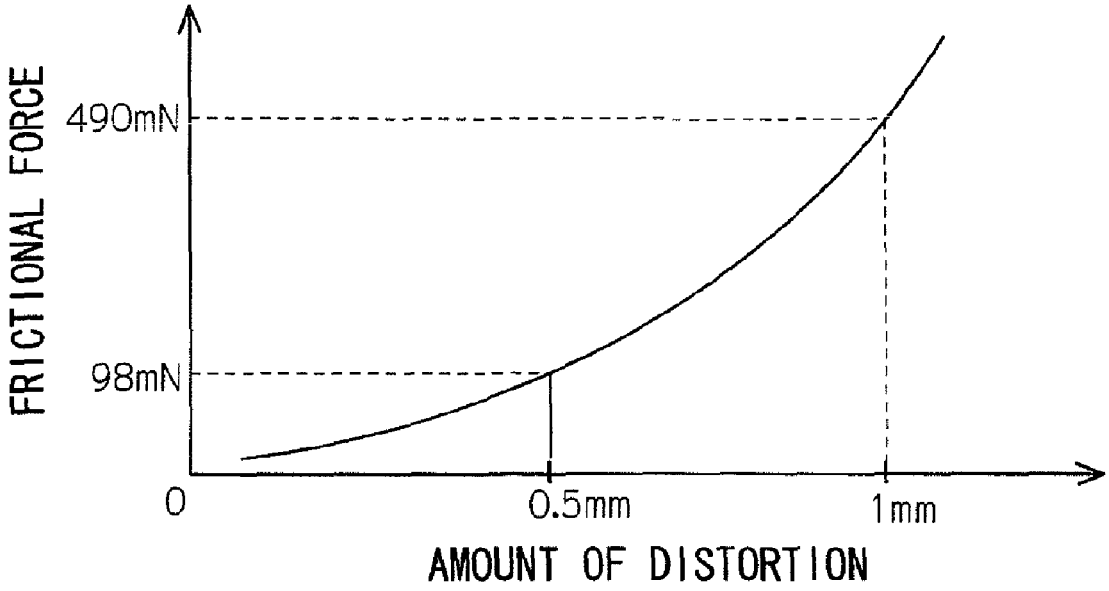
FIG. 23 is a graph showing an example of the relationship between the amount of distortion of the wiper and the frictional force.

FIG. 23 is a graph showing an example of the relationship between the amount of distortion δ of the wiper and the frictional force. The numerical values in the diagram are for the purpose of illustration, and they vary depending on conditions such as the material and structure of the wiper, and the like.

The amount of distortion δ of the wiper varies depending on the magnitude of the frictional force between the wiper and the nozzle surface, and since it displays a correlation such as that in FIG. 23, for example, then by storing the relevant correlation data and measuring the amount of distortion δ, it is possible to identify (infer) the frictional force.

Figure 24:
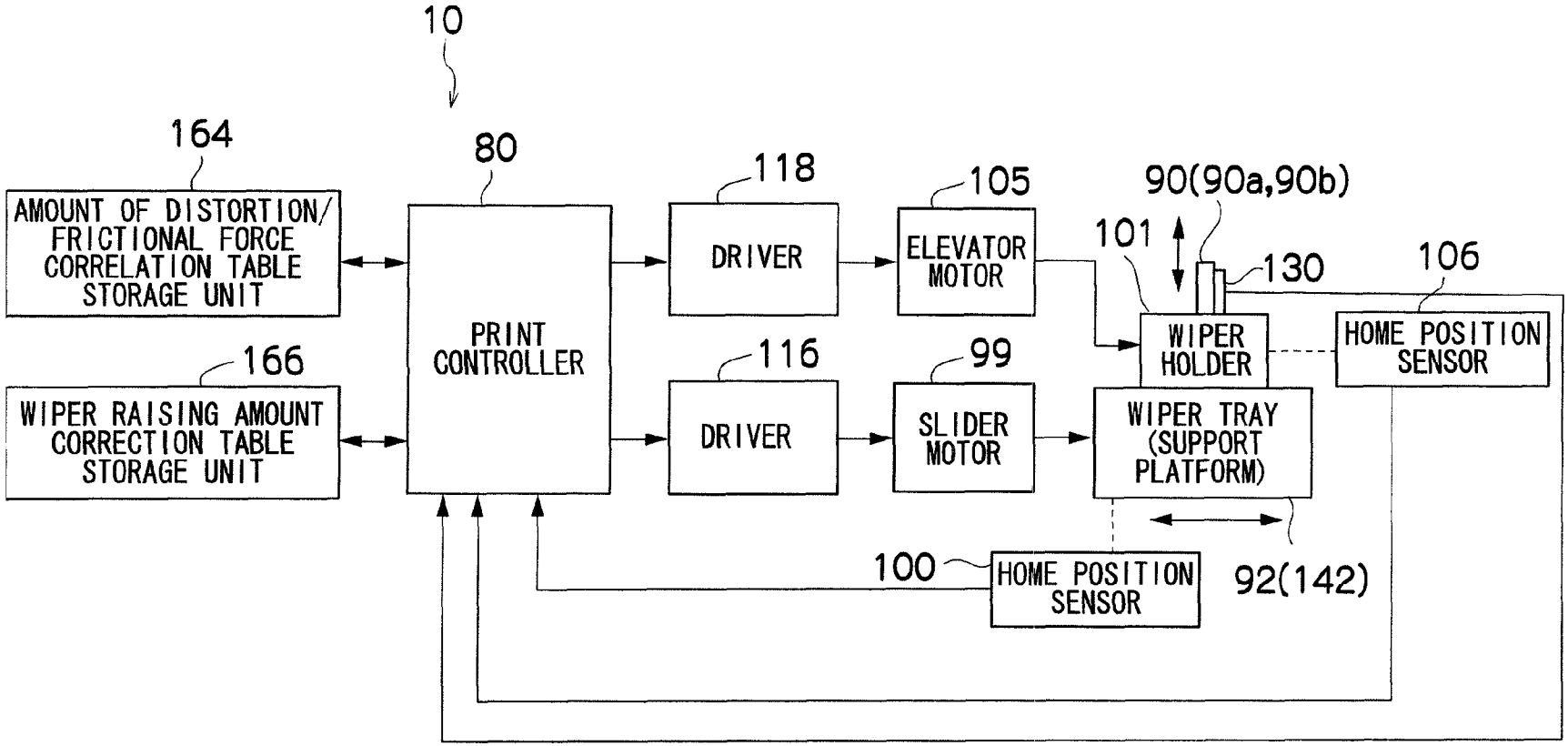
FIG. 24 is a principal block diagram showing an example of the composition of a control system of an inkjet recording apparatus.

FIG. 24 shows a principal block diagram of a control system which achieves the foregoing. In FIG. 24, elements which are the same as or similar to the compositional example in FIGS. 7 to 20 are denoted with the same reference numerals and description thereof is omitted here. In FIG. 24, the determination signal from the distortion gauge 130 appended to the wiper 90 is supplied to the print controller 80. Furthermore, the inkjet recording apparatus 10 according to the present embodiment comprises a storage unit for storing correlation data for the amount of distortion and frictional force such as that in FIG. 23 (this unit is indicated by reference numeral 164 in FIG. 24), and a storage unit 166 for storing a correctional table for the wiper raising amount (the relative position of the wiper 90 with respect to the nozzle surface) in accordance with the frictional force.

The information on the amount of distortion of the wiper 90 determined by the distortion gauge 130 during sliding operation of the wiper is inputted to the print controller 80 and the print controller 80 determines the frictional force from the correlation data in the storage unit 164, on the basis of the information on the amount of distortion thus obtained. A correctional value for the raising amount of the wiper corresponding to the frictional force thus identified is found from the correction table in the storage unit 166, and the raised position of the wiper 90 is corrected accordingly.

FIG. 24 shows an example in which correlation data and a corrective table are stored, but it is also possible to integrate these and to use a table which associates amount of distortion values with correctional values for the wiper raising amount, and in this respect, the present embodiment is similar to that shown in FIG. 13.

EXAMPLE 5

Mode Using Device for Reversing Sliding Direction

If the cleaning capability is identified by using any one of an amount of wear identification device as described in FIG. 12 and FIG. 13, or a contact pressure determination device or vibration determination device as shown in FIG. 14 to FIG. 20, or a frictional force identification device as shown in FIG. 21 to FIG. 24, or the like, or a suitable combination of these devices (these devices are referred to by the general term "cleaning capability identification device"), and if expiry of the lifespan of the wiper blade is determined, then it is possible to restore the cleaning capability by reversing the sliding direction of the wiper.

Figure 25B:
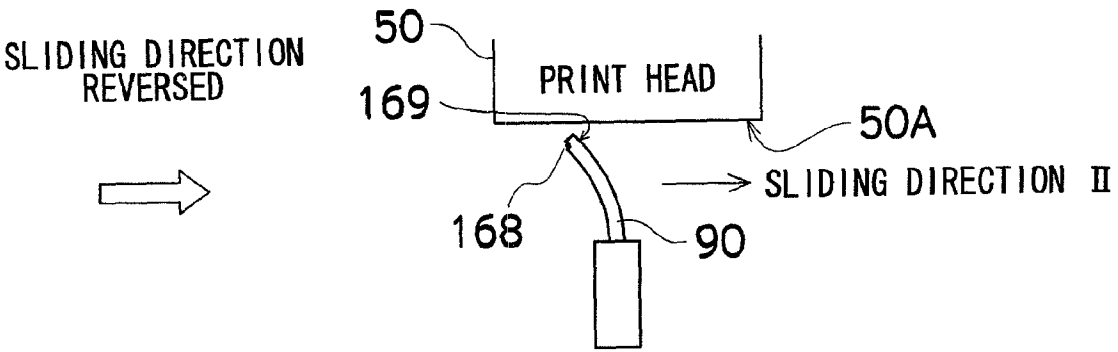
FIGS. 25A and 25B are schematic drawings showing a situation where the sliding direction of the wiper is reversed.
Figure 25A:
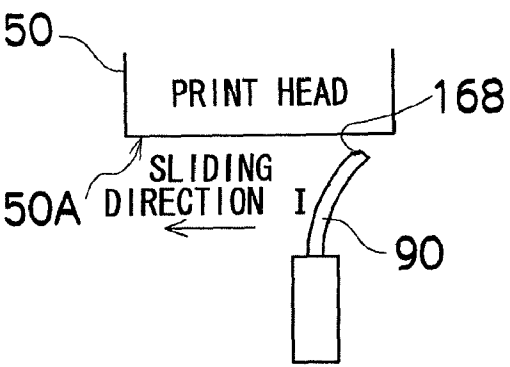

FIG. 25A and FIG. 25B show a schematic drawing of this. As shown in FIG. 25A, firstly, wiping is performed by sliding the wiper 90 in the first sliding direction I (the leftward direction in FIG. 25A). As sliding for cleaning is performed continuously in the first sliding direction I, one side of the tip edge portion of the wiper 90 (in FIG. 25A, the left-hand side portion indicated by reference numeral 168) eventually becomes worn.

The decline in the cleaning capability due to wearing of one side edge is judged from specified conditions, and on the basis of the corresponding judgment result, the sliding direction of the wiper 90 is reversed, without changing the orientation of the wiper 90, as shown in FIG. 25B. If sliding for cleaning is performed in the second sliding direction II which is opposite to the first sliding direction I, then as shown in FIG. 25B, the nozzle surface 50A is wiped with the edge 169 on the opposite side to the worn edge 168 (in other words, an unworn edge), and therefore, the cleaning capability is restored.

As regards the judgment condition for reversing the sliding direction, numbers of wipes may be previously associated with lifespan values (for the lifespan of one edge), and expiry of lifespan may be judged on the basis of the count result for the number of wipes. This mode can be achieved by adopting the compositional example shown in FIG. 13.

In another mode, the contact pressure of the wiper 90 is determined, and the sliding direction is reversed if the contact pressure is equal to or less than a specified value (for example, 1.96 kPa (≈20 gf/cm$^2$)). Alternatively, a mode is possible in which the vibration of the wiper during sliding over the nozzle surface is determined, and the sliding direction is reversed if vibration is determined which has an amplitude, frequency, or the like, exceeding specified values. As a contact pressure determination device or vibration determination device, it is also possible to use the compositional example shown in FIG. 14 to FIG. 20.

EXAMPLE 6

Mode Using Device for Restoring Surface Shape of Wiper Tip

If the cleaning capability is identified using an aforementioned cleaning capability identification device, and expiry of the lifespan of the wiper blade is determined, then it is possible to restore the cleaning capability by grinding the tip of the wiper in order to restore the surface shape thereof.

Figure 26A:
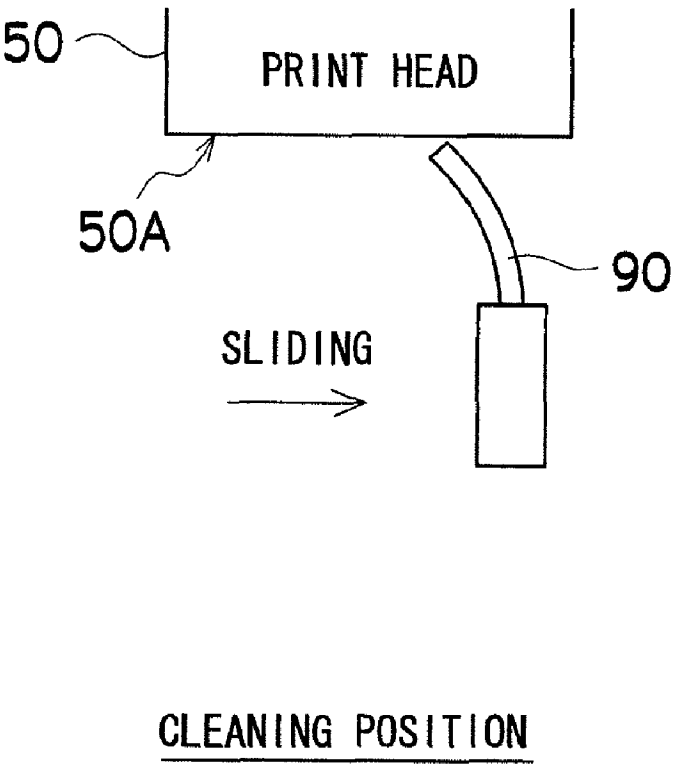
FIGS. 26A and 26B are schematic drawings showing one example of a surface shape restoring device for a wiper tip.
Figure 26B:
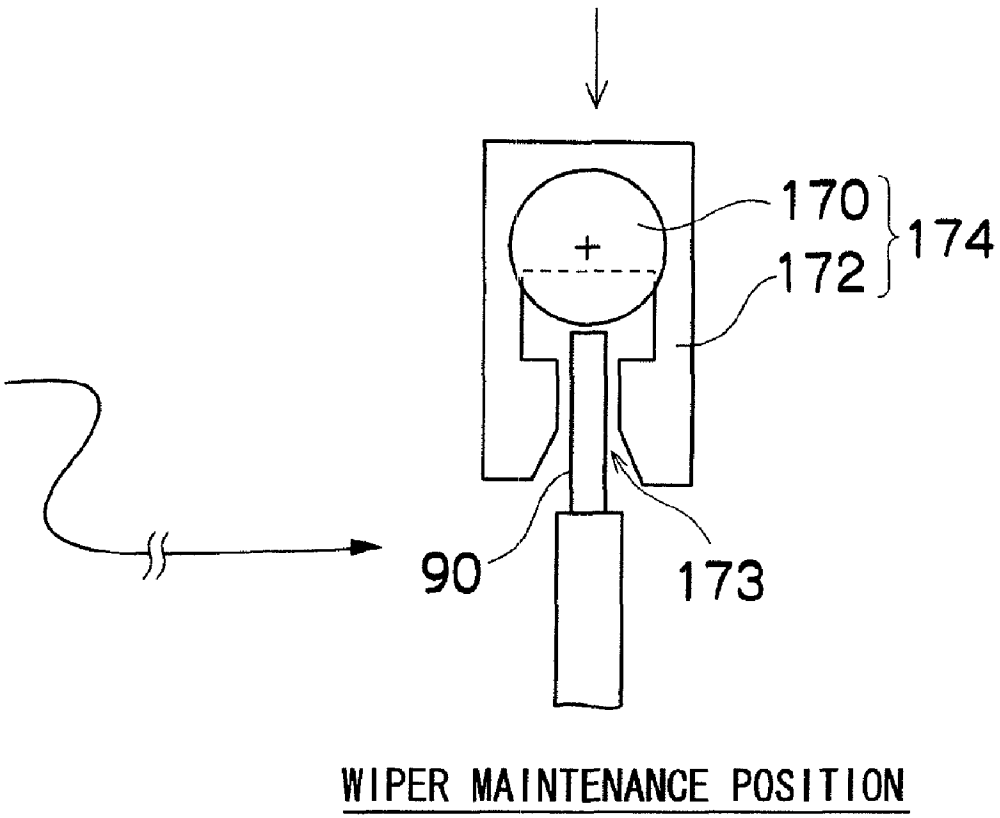

FIGS. 26A and 26B are schematic drawings showing one example of a surface shape restoring device for a wiper tip. As shown in FIG. 26A, by repeating wiping operation of the wiper 90 over the nozzle surface 50A of the print head 50, the cleaning capability eventually declines due to wearing of the wiper 90, and the like.

If a decline in the cleaning capability is judged from specific conditions, and expiry of the lifespan of the wiper is determined, then the wiper 90 is moved to a prescribed wiper maintenance position (FIG. 26B) from the cleaning position (FIG. 26A). A grinding unit 174 comprising a grinding roller 170 and a fixing unit 172 for restraining the wiper 90 is disposed in the wiper maintenance position, and this grinding unit 174 is movable in the upward and downward direction in the diagram, by means of an elevator mechanism (not shown).

After moving the wiper 90 to the wiper maintenance position, the grinding unit 174 waiting at standby in a standby position (withdrawal position) (not shown), is lowered as shown in FIG. 26B, thereby causing the grinding unit 174 to engage with the wiper 90. In this way, the grinding roller 170 is caused to rotate by a motor, or the like (not shown), while the vicinity of the tip section of the wiper 90 is pressed from either side by the inner surfaces of a wiper inserting section 173 of the fixing unit 172. After grinding, the grinding unit 174 is moved upward in the diagram and withdrawn to the standby position (not shown), and the wiper 90 is returned to its prescribed initial position (home position, or the like).

In this way, the surface shape of the tip of the wiper 90 is restored by grinding and reforming the tip, and therefore, the cleaning capability of the wiper 90 can be restored.

EXAMPLE 7

Mode Using Other Device for Restoring Surface Shape of Wiper Tip

Figure 27:
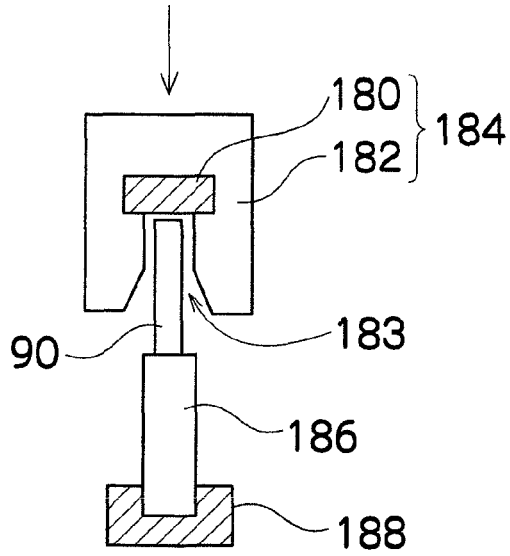
FIG. 27 is a schematic drawing showing a further example of a grinding device which can be used as a surface shape restoring device for a wiper tip.

FIG. 27 shows a further example of a grinding device. Instead of the grinding unit 174 shown in FIGS. 26A and 26B, it is also possible to use a grinding unit 184 comprising a planar grinding member 180 as a fixing unit 182, as shown in FIG. 27. In this case, a piezoelectric element 188 forming a vibrating device is provided on the lower surface of a holding section 186 which holds the wiper 90. It is preferable that the piezoelectric element 93 described in FIG. 12 (the contact pressure determination device or the vibration determination device) also serves as the piezoelectric element 188.

In the foregoing composition, the grinding unit 184 waiting at standby in a standby position (withdrawal position) (not shown) is lowered as shown in FIG. 27, whereby the grinding unit 184 engages with the tip section of the wiper 90. In this state where the tip of the wiper 90 is abutting against the planar grinding member 180, the piezoelectric element 188 is driven, thus applying a vibration to the wiper 90, and the tip section of the wiper 90 is ground by performing this slight vibration. A wiper inserting section 183 of the fixing unit 182 into which the wiper 90 is inserted ensures that there is sufficient clearance for applying a vibration, between the inner circumference of this section 183 and the wiper 90.

After grinding, the grinding unit 184 is moved upward in the diagram and withdrawn to the standby position (not shown), and the wiper 90 is returned to its prescribed initial position (home position, or the like), similarly to the example shown in FIGS. 26A and 26B.

FIGS. 26A and 26B and FIG. 27 show examples where the grinding unit 174 or 184 is raised and lowered, but instead of this or in conjunction with this, it is also possible to raise and lower the wiper 90. Other possible modes for a grinding device include a mode where the wiper 90 is abutted against a planar grinding member and ground by sliding the wiper 90 along the surface of the grinding member, or a mode where this is combined with a vibrating device as shown in FIG. 27, in such a manner that a slight vibration is applied to the tip section of the wiper while the wiper is slid over the surface of the grinding member.

EXAMPLE 8

Figure 28:
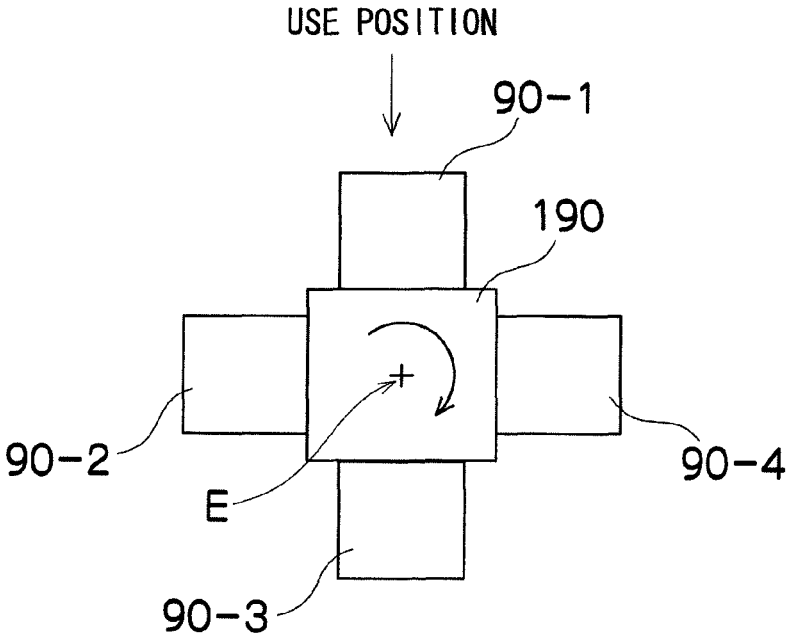
FIG. 28 is a schematic drawing showing one example of a wiper switching device.

Mode Where Plurality of Wipers are Prepared and Device for Switching Wiper to be Used is Employed FIG. 28 is a schematic drawing showing one example of a wiper switching device. FIG. 28 shows an example of a structure in which four wipers 90-*i* (where i=1, 2, 3, 4) are held by one wiper holder 190, and the wiper to be used is switched by rotating the wiper holder 190. Of course, the number of wipers is not limited in particular, and a wiper holder of a suitable shape is used, depending on the number of wipers.

According to FIG. 28, four wipers 90-*i* (where i=1, 2, 3, 4) are attached to a wiper holder 190 in the form of a multi-faced body. The wiper holder 190 has rotational symmetry every 90°, taking the axis of symmetry to be a straight line perpendicular to the surface of the paper and passing through the center point indicated by E in the diagram, and it is supported rotatably by means of a supporting mechanism (not shown). Furthermore, the rotational position of the holder can be controlled by a drive device, such as a motor, which is not shown.

The wipers 90-*i* (where i=1, 2, 3, 4) are different types of wiper having different wiping characteristics (cleaning effects), (for instance, wipers having different free length or rigidity, wipers having different tip shapes, absorbent blades having different ink absorption characteristics, and the like), and a suitable wiper (blade) is selected in accordance with the determination results for nozzle ejection abnormalities, the state of the nozzle surface, or determination results for the operational state of the wiper during sliding over the nozzle surface, or the like. According to this mode, it is possible to implement effective cleaning in accordance with the circumstances, and therefore, cleaning performance can be improved.

Furthermore, by adopting the mechanism shown in FIG. 28 and installing a plurality of wipers of the same type having substantially the same wiping characteristics on the wiper holder, and then switching between these wipers sequentially, it is possible to maintain the cleaning capability. More specifically, if the cleaning capability is identified using a cleaning capability identification device and expiry of the lifespan of the wiper blade is determined, then it is possible to restore the cleaning capability by switching the wiper by means of the mechanism shown in FIG. 28.

For example, in FIG. 28, if the wiper indicated by the reference numeral 90-1 is the currently selected (current used) wiper, then if the cleaning capability of this wiper 90-1 has fallen below prescribed conditions, the wiper holder 190 is rotated and a different wiper (for example, wiper 90-2) is moved to the use position. As a judgment condition for switching the wiper, there is a mode where expiry of the lifespan is determined from the number of wipes, similarly to Example 7 described above, or modes where expiry of the lifespan is determined when the contact pressure of the wiper is equal to or less than a specific value (for example, 1.96 kPa ($\approx$20 gf/cm$^2$), or when a vibration equal to or greater than a specific value is determined by the vibration determination device.

EXAMPLE 9

Mode for Raising Cleaning Effects by Using Device for Applying Vibration to Wiper By applying a relative vibration (and desirably, an ultrasonic vibration) between the wiper and the nozzle surface during sliding for cleaning, the cleaning action caused by the wiping and the cleaning action caused by the vibration combine with each other to produce an increased cleaning effect.

Figure 29:
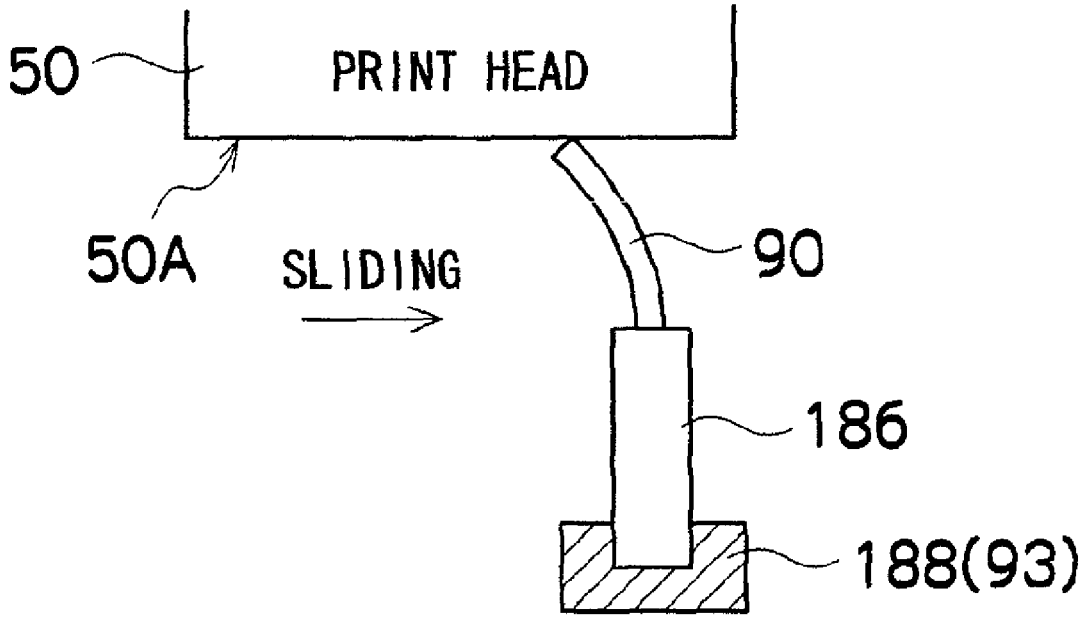
FIG. 29 is a schematic drawing showing an example in which cleaning effects are raised by combining wiper sliding with a vibrating device.

FIG. 29 is a schematic drawing showing an example in which cleaning effects are raised by combining wiper sliding with a vibrating device. It is preferable that the piezoelectric element 93 shown in FIG. 14 (the pressure contact determination device or vibration determination device) also serves as a piezoelectric element 188 forming a vibrating device for the wiper 90.

During sliding for cleaning, the piezoelectric element 188 applies an ultrasonic vibration to the wiper 90 by vibrating at a frequency of several kHz to 100 kHz. Preferably, the vibration is applied in a wet state (after ejecting ink from the nozzles onto the tip of the wiper). Thereby, the cleaning by wiping achieved by sliding the wiper 90 is multiplied by the effects of ultrasonic cleaning, and therefore, the cleaning capability is improved. The cleaning effect is improved in particular with respect to the elimination of fixed material which has adhered to the nozzle surface.

The sliding for cleaning combined with vibration as described above may be implemented with respect to the whole of the nozzle surface 50A, or rather, solid adhering matter in particular positions may be determined by means of the vibration determination device (described in FIG. 14 and FIG. 16A), and vibrational cleaning may be implemented selectively in respect of the region in the vicinity of this solid adhering matter.

EXAMPLE 10

Figure 30:
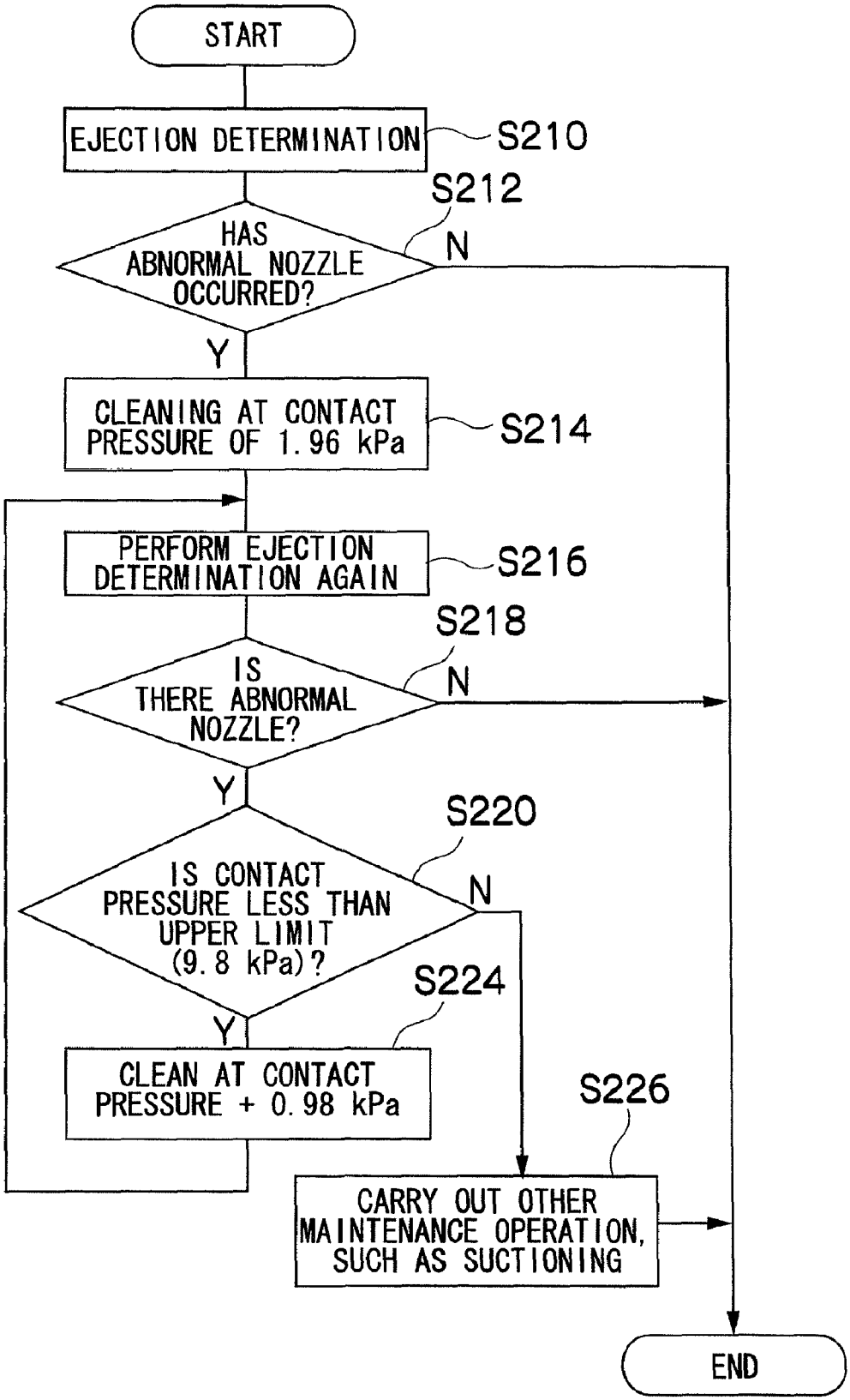
FIG. 30 is a flowchart showing one example of control for implementing cleaning by altering the contact pressure of the wiper on the nozzle surface.

Mode for Increasing Cleaning Capability by Altering Contact Pressure of Wiper FIG. 30 is a flowchart showing one example of control for implementing cleaning by altering the contact pressure of the wiper on the nozzle surface.

Firstly, at step S210, a nozzle producing an ejection defect (abnormality) is determined. As stated previously, the determination method uses the print determination unit 24, or another ejection determination device. The presence of an abnormal nozzle is determined from the results of ejection determination (step S212), and if an abnormal nozzle is not detected, then there is no particular need to carry out cleaning and the procedure ends.

On the other hand, if the ejection determination process detects an abnormal nozzle which is giving rise to a flight direction abnormality, an ejection volume abnormality, an ejection failure, or another type of ejection defect, then a YES verdict is produced at step S212 and the procedure then advances to the next step, S214.

In step S214, sliding for cleaning is performed by setting the contact pressure of the wiper 90 to a prescribed initial value (for example, 1.96 kPa (≈20 gf/cm$^2$). Desirably, this initial value is set to a comparatively low value, taking account of the durability and cleaning properties of the liquid repelling layer formed on the nozzle surface (see reference numeral 59 in FIG. 4). As shown in FIG. 30, ejection determination is carried out again after performing a cleaning slide (step S216), and it is judged whether or not the ejection abnormality has been resolved by the cleaning operation (step S218). If no abnormal nozzle is determined at step S218, then the procedure ends.

Furthermore, if an abnormal nozzle is determined at step S218, then the procedure advances to step S220. At step S220, it is confirmed whether or not the current set value for the contact pressure is less than the prescribed upper limit (for example, 9.8 kPa (≈100 gf/cm$^2$). If the contact pressure of the wiper 90 during the previous cleaning operation has been less than the prescribed upper limit, then the set value of the contact pressure is increased by a prescribed value (for example, 0.98 kPa (≈10 gf/cm$^2$), and sliding for cleaning is carried out at the new contact pressure (step S224). After the sliding for cleaning in step S224, the procedure returns to step S216.

In this way, the processing in steps S216 to S224 is repeated until an abnormal nozzle is no longer determined at step S218, or until the contact pressure reaches the prescribed upper limit value in step S220.

If it is not possible to resolve an ejection abnormality, even after cleaning by raising the contact pressure to the prescribed upper limit, in other words, if the contact pressure has reached the prescribed upper limit at step S220, without it being confirmed at step S218 that the ejection abnormality has been resolved, then it is not possible to restore the abnormal nozzle simply by means of cleaning through wiping, and therefore, a separate maintenance operation, such as suctioning, is carried out (step S226), whereupon the procedure ends.

According to the control example described above, normally, cleaning is performed at a relatively low contact pressure, and therefore the lifespan of the liquid repelling layer of the nozzle surface and the lifespan of the wiper can be improved. On the other hand, by raising the contact pressure according to requirements, it is possible even to eliminate foreign matter that has adhered to the surface of the nozzle, and therefore the cleaning capability is improved.

EXAMPLE 11

Mode for Determining State of Nozzle Surface and Implementing Suitable Cleaning Operation As a device for determining the state of the nozzle surface during a wiper is sliding over the nozzle surface (namely, a nozzle surface state determination device), it is possible to use the vibration determination device described in Example 3 or the frictional force identification device described in Example 4.

Figure 31A:
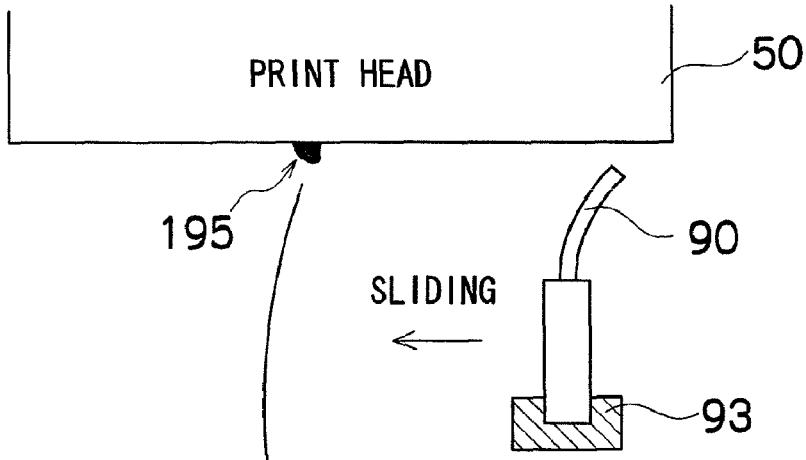
FIGS. 31A and 31B are schematic drawings of a case where the state of the nozzle surface is determined by using a vibration determination device.
Figure 31B:
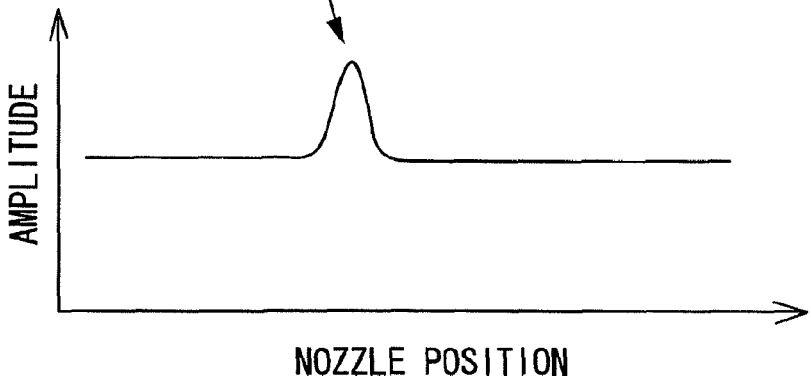

FIGS. 31A and 31B are schematic drawings of a case where the state of the nozzle surface is determined by using a vibration determination device. As shown in FIG. 31A, if solid adhering matter 195 has become attached to the nozzle surface 50A of the print head 50, then when the wiper 90 is slid over the nozzle surface, the signal determined by the vibration determination device (piezoelectric element 93) of the wiper 90 will change significantly in amplitude at the position corresponding to the position where the solid adhering matter 195 is attached to the nozzle surface, as shown in FIG. 31B.

By using this principle of determination, it is possible to identify the presence or absence of solid adhering matter 195 on the nozzle surface 50A, and the position at which it is attached to same, (namely, the locality of the soiling), from the state of vibration of the wiper 90 (the vibration determination signal).

A vibration determination device has been described in FIGS. 31A and 31B, but if a frictional force identification device as shown in FIG. 21 to FIG. 24 is used, then similarly, the determination value (measurement value) will change significantly at the position of the solid adhering matter 195, and therefore, the locality of the soiling can be identified by using a frictional force identification device.

Figure 32:
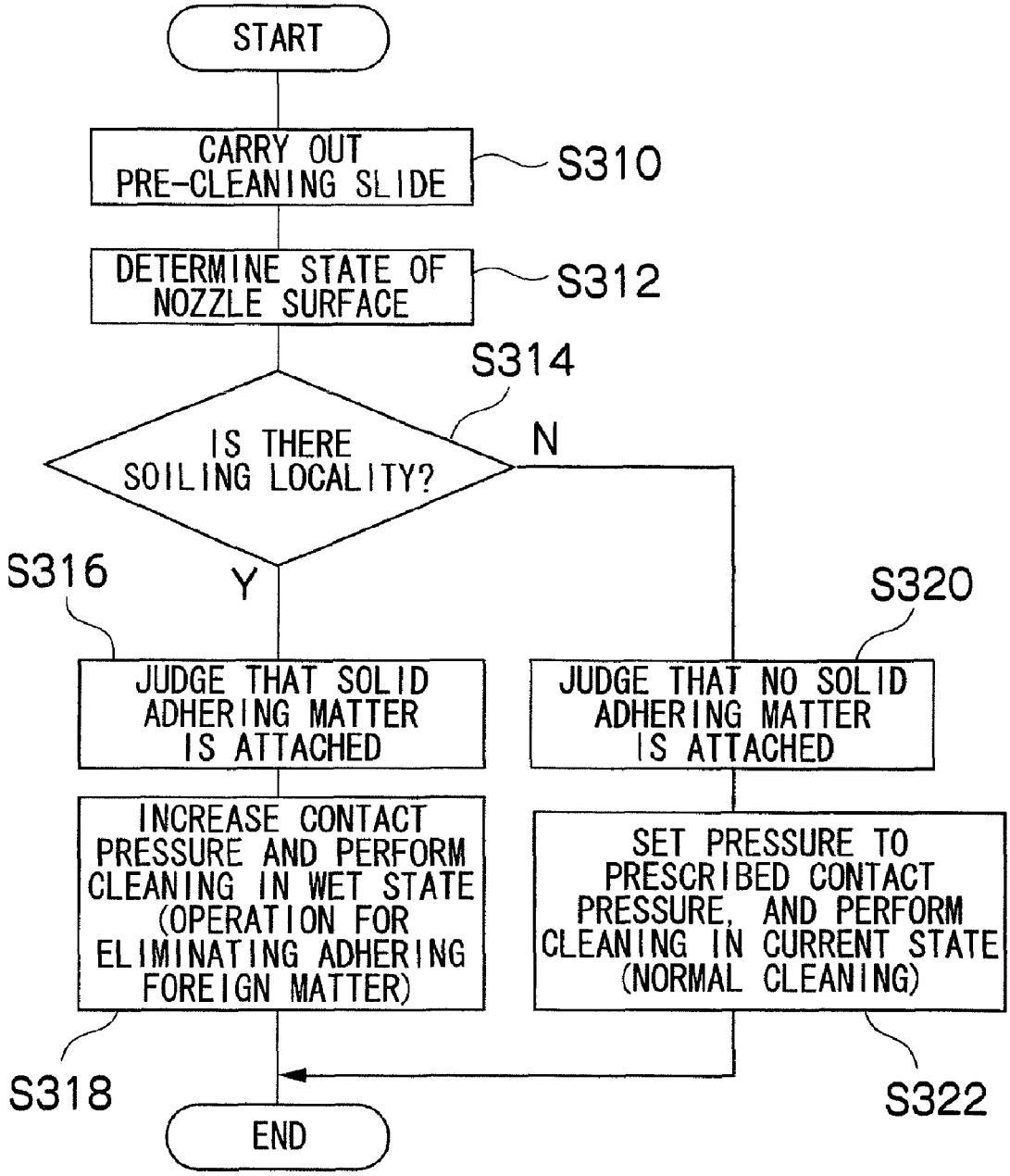
FIG. 32 is a flowchart showing an example in which a cleaning operation is controlled on the basis of the determination results obtained by the nozzle surface state determination device descried above.

FIG. 32 is a flowchart showing an example in which a cleaning operation is controlled on the basis of the determination results obtained by the nozzle surface state determination device descried above.

As shown in FIG. 32, firstly, a pre-cleaning slide is performed (step S310), and the state of the nozzle surface is determined by determining the wiper vibrations by means of the vibration determination device, or determining the frictional force by means of the frictional force identification device, or the like, during this movement (step S312). A pre-cleaning slide may be a cleaning operation which is performed especially in order to determined the state of the nozzle surface (namely an operation set to different cleaning conditions, such as different contact pressure), or alternatively, the normal cleaning operation carried out previously may be treated as a pre-cleaning slide.

Next, the locality of the soiling is judged on the basis of the determination results at step S312 (step S314). As shown in FIGS. 31A and 31B, if a large vibration is determined, then a YES verdict is produced at step S314 in FIG. 32, and it is judged that solid adhering matter is attached to the nozzle surface (step S316). In this case, the contact pressure is set to a greater value than the prescribed contact pressure set during a normal cleaning slide, and a cleaning slide is carried out in a wet state (step S318). Thereby, performance in eliminating solid adhering matter (foreign matter) is improved.

On the other hand, if a soiling locality is not determined at step S314, then it is judged that there is no solid adhering matter attached to the nozzle surface (step S320). In this case, the pressure is set to the prescribed contact pressure, and a cleaning slide (normal cleaning) is carried out without controlling the state of wetting (without ejecting ink) (step S322).

EXAMPLE 12

Figure 33:
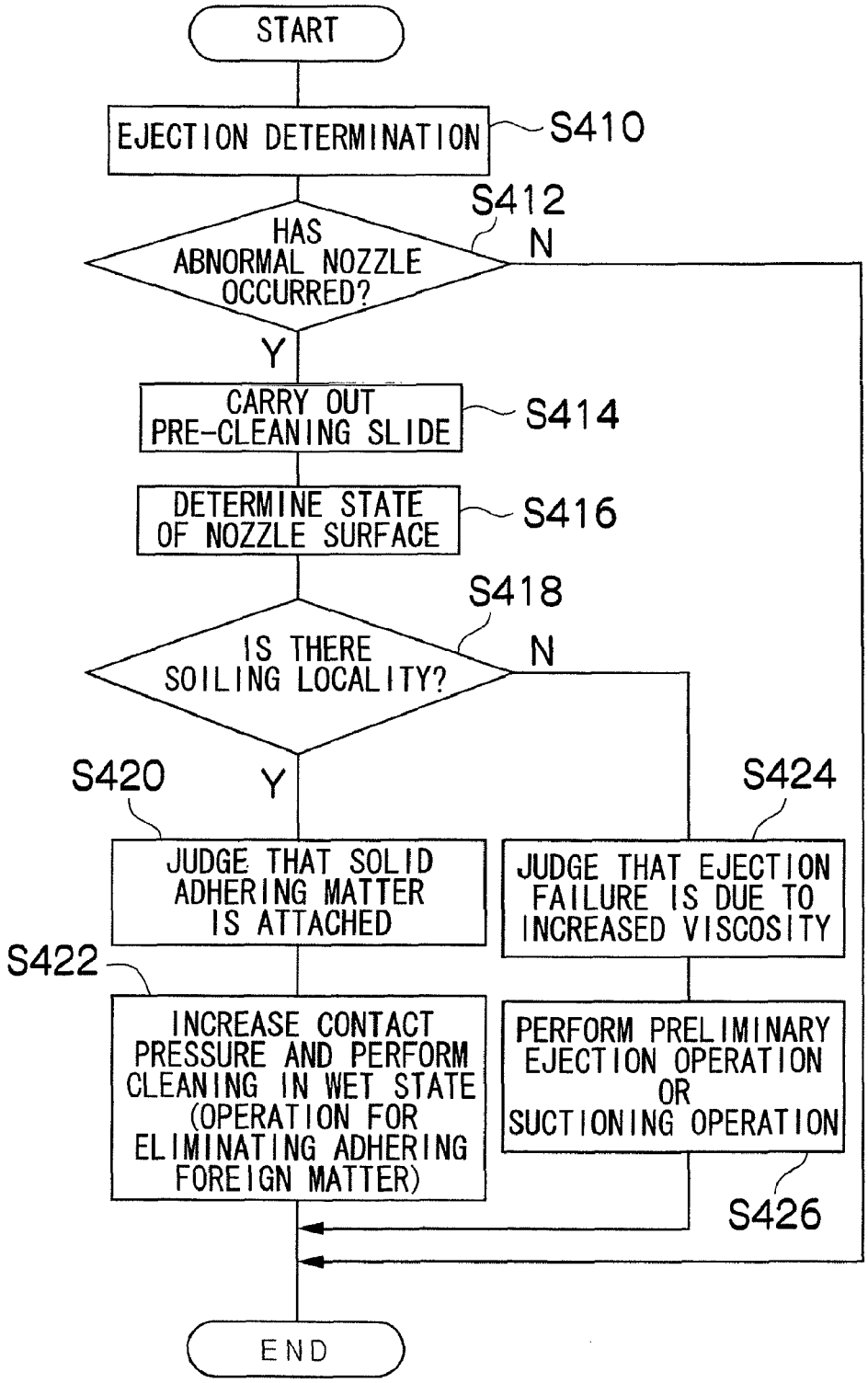
FIG. 33 is a flowchart showing an example in which ejection failure determination and nozzle surface state determination are combined, and the cleaning operation is controlled on the basis of these determination results.

Mode for Implementing Suitable Cleaning Operation by Combining Ejection Failure Determination and Nozzle Surface State Determination FIG. 33 is a flowchart showing an example in which ejection failure determination and nozzle surface state determination are combined, and the cleaning operation is controlled on the basis of these determination results.

Firstly, at step S410, nozzles suffering an ejection defect (abnormality) are determined. As stated previously, the determination method uses a print determination unit 24 or other ejection determination device. The presence or absence of an ejection failure nozzle is judged from the ejection determination results (step S412), and if no ejection failure nozzle is determined, then the procedure ends.

On the other hand, at step S412, if an ejection failure nozzle is determined at step S412, then a pre-cleaning slide is performed (step S414), and the nozzle surface state is determined by determining the vibration of the wiper during the movement, by means of a vibration determination device, or by determining the frictional force by means of a frictional force identification device (step S416).

Next, the locality of the soiling is judged on the basis of the determination results at step S416 (step S418). As described in FIGS. 31A and 31B, if a large vibration is determined, then a YES verdict is produced at step S418 in FIG. 33, and it is judged that there is an ejection failure due to the attachment of solid adhering matter (step S420). In this case, the contact pressure is set to a greater value than the prescribed contact pressure set during a normal cleaning slide, and a cleaning slide is carried out in a wet state (step S422). Thereby, performance in eliminating solid adhering matter (foreign matter) is improved.

On the other hand, if a soiling locality is not determined at step S418, then it is judged that the ejection failure is one caused by increased in the viscosity of the ink, rather than by the attachment of solid adhering matter (step S424). In this case, a restoration operation is carried out, such as a preliminary ejection operation, or a suction operation, or a combination of these (step S426).

In this way, by deciding the maintenance operation to be performed by a combination of determination results for the nozzle surface state and ejection failures, it is possible to shorten the maintenance time and reduce the amount of ink consumed.

EXAMPLE 13

Figure 34:
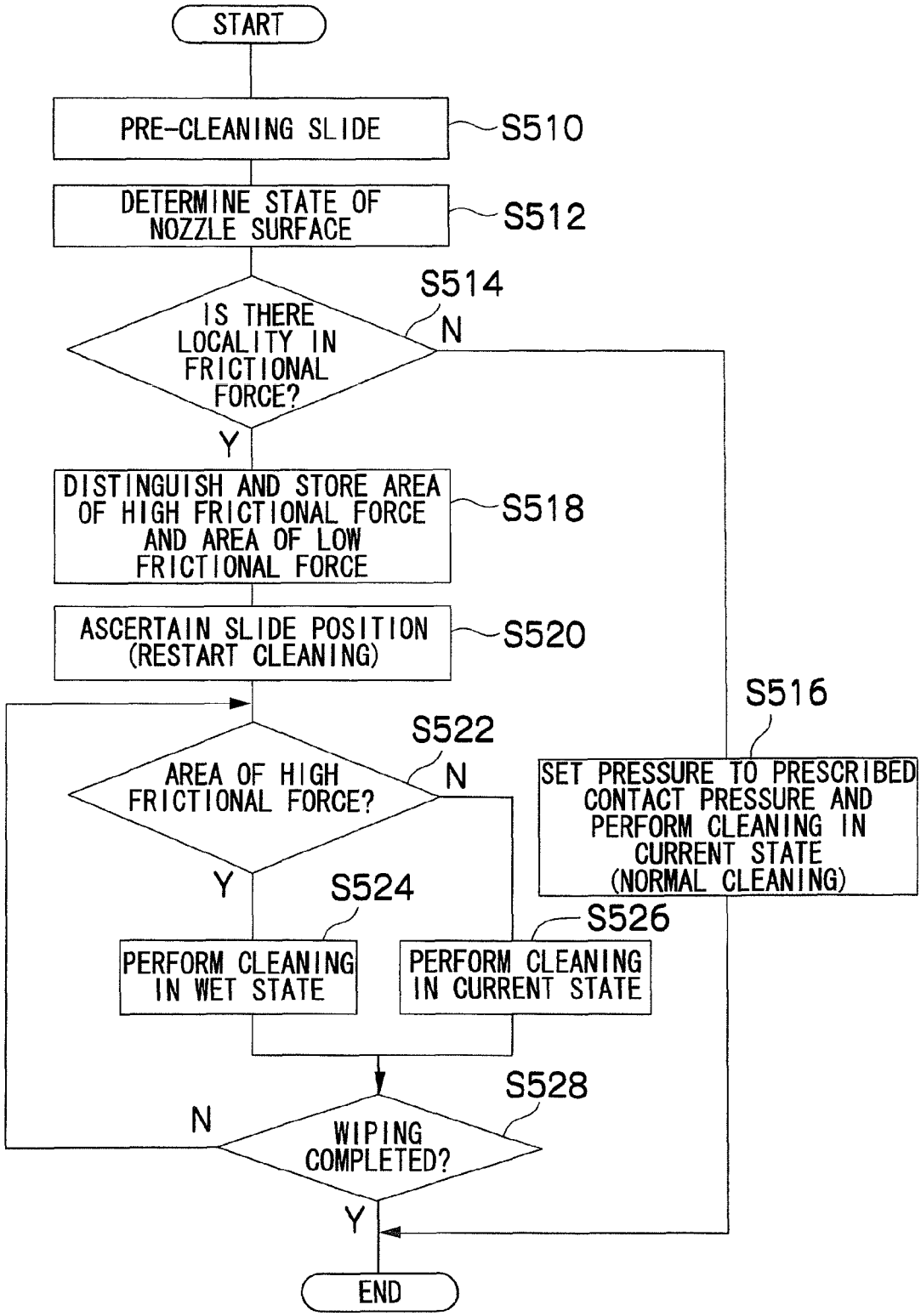
FIG. 34 is a flowchart showing an example of a control sequence in which a cleaning method is selected on the basis of the determination results for the frictional force during sliding over the nozzle surface.

Mode for Carrying Out Suitable Cleaning Operation by Determining Frictional Force During Sliding Over Nozzle Surface FIG. 34 is a flowchart showing an example of a control sequence in which a cleaning method is selected on the basis of the determination results for the frictional force during sliding over the nozzle surface.

As shown in the diagram, firstly, a pre-cleaning slide is performed (step S510), and during this movement, the state of the nozzle surface (in this case, the frictional force, in particular) is determined by using a frictional force identification device (described in Example 4) (step S512).

Next, the locality of the frictional force on the nozzle surface is determined on the basis of the determination result at step S512 (step S514). The locality of the frictional force can be determined at the nozzle surface in accordance with the state of attachment of solid adhering matter and liquid (namely, the distribution thereof, such as the position of attachment, the attached volume, and the like). For example, a prescribed judgment reference value is set previously, and if a frictional force (or a motor current value or amount of distortion corresponding to the frictional force) exceeding the prescribed judgment reference value is not determined, then it is judged that there is no locality.

In this case, the procedure advances to step S516, the pressure is set to the prescribed contact pressure, and sliding for cleaning (normal cleaning) is carried out without controlling the wet state (without ejecting ink).

On the other hand, if at step S514 there has been a position at which a frictional force exceeding the prescribed judgment reference value has been determined, then it is judged that there is a locality in the frictional force, and the procedure advances to step S518.

At step S518, the nozzle surface is divided broadly into an area where the frictional force is greater than a prescribed judgment reference value, and an area where it is smaller than this reference value, and the positional information for each area is stored.

Thereupon, the information on the slide position is obtained, in such a manner that the sliding for cleaning is restarted (step S520). On the basis of the information stored at step S518 and the current positional information, it is judged whether or not the cleaning position is located in an area of high frictional force (step S522).

If the cleaning position is in an area of high frictional force, then cleaning is performed in a wet state, by ejecting ink from the nozzles (step S524). Furthermore, if the cleaning position is in an area of low frictional force, then no ink is ejected from the nozzles and cleaning is carried out in the current state (step S526).

Next, it is judged whether or not the cleaning slide has been completed within a prescribed movement range (step S528). This judgment is made on the basis of the count value for the number of pulses for the slider motor 99 as shown in FIG. 9, or on the basis of the signal from the limit sensor 158 described in FIG. 22. If the cleaning slide has not been completed, then the procedure returns to step S522 in FIG. 34, and the processing steps S522 to 528 are repeated.

When it has been confirmed at step S528 that the cleaning slide has been completed within the prescribed movement range, then the procedure ends.

The specific examples, Examples 1 to 13, described above may be combined in a suitable manner, and various different types of cleaning methods may be achieved depending on the mode of combination.

Modification of the Embodiments

In the foregoing explanation, a composition relating to split wipers 90*a*, 90*b* has been described, but the scope of application of the present invention is not limited to this, and it may also be applied similarly to a composition using one long wiper, which is not split.

In the embodiment described above, an inkjet recording apparatus using a full line type head having a nozzle row of a length corresponding to the entire width of the recording medium has been described, but the scope of application of the present invention is not limited to this, and the present invention may also be applied to an inkjet recording apparatus using a shuttle head which performs image recording while moving a short recording head reciprocally.

Moreover, in the foregoing explanation, an inkjet recording apparatus has been described as one example of an image forming apparatus, but the scope of application of the present invention is not limited to this. For example, the liquid ejection apparatus according to the present invention may also be applied to a photographic image forming apparatus in which developing solution is applied onto a printing paper by means of a non-contact method. Furthermore, the scope of application of the liquid droplet ejection head according to the present invention is not limited to an image forming apparatus, and the present invention may also be applied to various other types of apparatuses which spray a processing liquid, or other liquid, toward an ejection receiving medium by means of a liquid ejection head (such as a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head having an ejection port surface on which ejection ports for ejecting liquid are formed;

a wiping device having a blade member which wipes and cleans the ejection port surface;

a sliding device which causes the blade member to slide relatively with respect to the ejection port surface;

a distortion measurement device which measures an amount of distortion of the blade member caused by bending deformation of the blade member while the sliding device causes the blade member to slide over the ejection port surface; and a cleaning capability modification device which modifies a cleaning capability of the wiping device in accordance with a measurement result of the distortion measurement device.

2. The liquid ejection apparatus as defined in claim 1, wherein the distortion measurement device includes a distortion gauge arranged on a side face of the blade member, the distortion measurement device measuring the amount of distortion caused by bending deformation of the blade member by means of the distortion gauge.

3. The liquid ejection apparatus as defined in claim 2, further comprising:

a first storage unit which stores correlation data indicating a correlation between the amount of distortion of the blade member and a frictional force between the blade member and the port ejection surface;

a second storage unit which stores a corrective table associating the frictional force and a position of the blade member relative to the ejection port surface in a direction perpendicular to the ejection port surface; and a relative position control device which controls the position of the blade member relative to the ejection port surface in the direction perpendicular to the ejection port surface with reference to the correlation data and the corrective table in accordance with the amount of distortion of the blade member measured by means of the distortion gauge while the sliding device causes the blade member to slide over the ejection port surface.

4. The liquid ejection apparatus as defined in claim 2, further comprising:

a storage unit which stores a table associating the amount of distortion of the blade member and a position of the blade member relative to the ejection port surface in a direction perpendicular to the ejection port surface; and a relative position control device which controls the position of the blade member relative to the ejection port surface in the direction perpendicular to the ejection port surface with reference to the table in accordance with the amount of distortion of the blade member measured by means of the distortion gauge while the sliding device causes the blade member to slide over the ejection port surface.

5. The liquid ejection apparatus as defined in claim 2, further comprising:

a storage unit which stores correlation data indicating a correlation between the amount of distortion of the blade member and a frictional force between the blade member and the port ejection surface; and a frictional force identification device which identifies the frictional force between the blade member and the port ejection surface with reference to the correlation data in accordance with the amount of distortion of the blade member measured by means of the distortion gauge while the sliding device causes the blade member to slide over the ejection port surface, wherein the cleaning capability modification device includes a cleaning control device which selects a cleaning method in accordance with a magnitude of the frictional force identified by the frictional force identification device, when a frictional force locality is detected on the ejection port surface according to information obtained by the frictional force identification device.

6. The liquid ejection apparatus as defined in claim 1, wherein the distortion measurement device provides a measurement signal corresponding to the amount of distortion of the blade member caused by bending deformation of the blade member.

7. The liquid ejection apparatus as defined in claim 1, wherein the cleaning capability modification device comprises at least one of:

a relative position control device which controls a position of the blade member relative to the ejection port surface in a direction perpendicular to the ejection port surface;

a relative speed control device which controls a speed of the blade member relative to the ejection port surface while the sliding device causes the blade member to slide over the ejection port surface; and a wet state control device which controls a state of wetting between the blade member and the ejection port surface.

* * * * *